US006930665B2

(12) United States Patent
Sekine

(10) Patent No.: US 6,930,665 B2
(45) Date of Patent: Aug. 16, 2005

(54) DISPLAY DEVICE FOR D/A CONVERSION USING LOAD CAPACITANCES OF TWO LINES

(75) Inventor: Hiroyuki Sekine, Tokyo (JP)

(73) Assignee: NEC Corporation, Tokyo (JP)

( * ) Notice: Subject to any disclaimer, the term of this patent is extended or adjusted under 35 U.S.C. 154(b) by 356 days.

(21) Appl. No.: 10/353,951

(22) Filed: Jan. 30, 2003

(65) Prior Publication Data

US 2003/0146896 A1 Aug. 7, 2003

(30) Foreign Application Priority Data

Feb. 1, 2002 (JP) ..... 2002-025520

(51) Int. Cl.[7] ..... G09G 3/36
(52) U.S. Cl. ..... 345/100; 345/98; 345/93
(58) Field of Search ..... 345/87, 90, 92, 345/93, 98, 100, 204, 205

(56) References Cited

U.S. PATENT DOCUMENTS 6,049,321 A * 4/2000 Sasaki ..... 345/99
6,075,505 A * 6/2000 Shiba et al. ..... 345/87
6,380,920 B1 * 4/2002 Ozawa ..... 345/100
6,597,349 B1 * 7/2003 Koyama et al. ..... 345/204

FOREIGN PATENT DOCUMENTS

JP 6-214214 8/1994
JP 10-54998 2/1998
JP 2000-131670 5/2000
JP 2000-227585 8/2000
JP 2000-305527 11/2000

OTHER PUBLICATIONS

Y. Matsueda et al., "Low–Temperature Poly–Si TFT–LCD with Integrated 6–bit Digital Data Drivers", SID 96 Digest, pp. 21–24.

* cited by examiner

*Primary Examiner*—Ricardo Osorio
(74) *Attorney, Agent, or Firm*—Young & Thompson

(57) ABSTRACT

A display device uses the load capacitances of two signal lines to perform DA conversion. Serial digital/analog conversion circuits (SDAC) in a data driver are provided for every two adjacent signal lines and use the load capacitances of these two signal lines to successively convert to analog data those data from the parallel/serial conversion circuits (PSC), PSC that correspond to the pixels of odd-numbered pixel columns and apply the converted analog data to the pixels of odd-numbered pixel columns, and successively apply data from PSC that correspond to the pixels of even-numbered pixel columns to the pixels of even-numbered pixel columns. Because the source of error of the SDAC is determined only by the difference between the two load capacitances, a polysilicon liquid crystal display device may be and the characteristics of the TFT may consequently show fluctuation, but will not act as an error source.

17 Claims, 19 Drawing Sheets

DISPLAY DEVICE FOR D/A CONVERSION USING LOAD CAPACITANCES OF TWO LINES

BACKGROUND OF THE INVENTION

1. Field of the Invention

The present invention relates to display devices such as an organic EL (Electro Luminescence) image display device and a liquid crystal display device that are provided with a pixel matrix in which a plurality of pixels are arranged in matrix form, and more particularly to an organic EL image display device and liquid crystal display device for receiving digital image signals and driving each pixel of the pixel matrix, as well as to a method of driving such devices.

2. Description of the Related Art

Owing to their superior display characteristics, active matrix-type liquid crystal display devices in which TFT (Thin-Film Transistors), which are active elements, are provided in each pixel have become the mainstream in current liquid crystal display devices. Among these active matrix liquid crystal display devices, the current trend is towards devices that employ polysilicon TFTs as the active elements. This is because, when polysilicon TFTs are used for each pixel, in addition to the pixel TFTs, the gate drivers for driving the scanning lines that are connected to the gates of the pixel TFTs as well as the data driver for driving the signal lines that are connected to the source terminals of the pixel TFTs can be produced at the same time on the glass substrate on which the pixels are fabricated. This enables a dramatic reduction of the number of connection terminals between the liquid crystal display device and outside circuits, a miniaturization of the liquid crystal display device module, a simplification of external circuits, and further, a decrease in cost. However, polysilicon TFT exhibit a high degree of variation of characteristics in comparison with single-crystal silicon transistors, and a highly accurate analog circuit is therefore difficult to realize. As a result, a data driver that handles image signals, which are analog signals, frequently consists of simple switches for sampling signals that are supplied from outside circuits and scanning circuits for controlling these switches. Voltage that is applied to the liquid crystal element must be ±5 V with respect to the opposite electrode, and the analog image signal that is supplied to the liquid crystal display device therefore has voltage amplitude of about 10 V. In addition, the frequency of the analog image signal is relatively high from several MHz to several tens of MHz and therefore is a large burden on the outside circuits that supply the image signal to the liquid crystal display device.

For these reasons, many attempts have been made to achieve a simplification of the outside circuits and a lower cost by supplying image signals to the liquid crystal display device in the form of digital data and then converting to analog signals in the liquid crystal display device. More specifically, a DAC (Digital-Analog Converter) is provided in the data driver to enable the liquid crystal display device to handle digital image signals. FIG. 1 shows a representative example of a DAC that is used in a data driver of such a liquid crystal display device. DAC 50 shown in FIG. 1 is an equivalent representation of the DAC (Digital-Analog Converter) for a polysilicon TFT data driver that was reported in "Y. Matsueda (SID (Society for Information Display), 1996 Digest, pp. 21–24.)". This DAC 50 is a variation of a device generally referred to as a capacitor-array DAC and realizes digital/analog conversion by means of charge redistribution between a binary-weighted capacitor array C1–Cn, auxiliary capacitor C0, and load capacitance (parasitic capacitance) Cd of the signal line that is the load of DAC 50. In this construction, DAC 50 can consist of capacitances C1–Cn and switches, and has the merit of enabling DAC at relatively high accuracy despite the use of polysilicon TFTs, which exhibit a relatively high degree of variation in characteristics between elements.

Nevertheless, this method has two problems. First, the output of DAC 50 that is described here, in contrast with a typical capacitor-array DAC, is supplied directly to signal lines, which is the load, without passing through an analog amplifier, and the output voltage is therefore lower than the voltage that is applied to capacitor-array C1–Cn. Solving this problem necessitates the incorporation of a capacitor array having a capacitance of the same or a higher level of capacitance than the load capacitance Cd of the signal line, which is the load. This case creates a new problem in that the circuit area of DAC 50 increases.

The second problem is that raising the resolution of DAC 50 results in a simultaneous increase in the circuit area. This problem occurs because the resolution (number of digital data bits) is equal to the number of capacitor arrays.

The above-described problems occur not only in a liquid crystal display device but also similarly occur in an active matrix EL (Electro Luminescence) image display device.

SUMMARY OF THE INVENTION

It is an object of the present invention to provide an EL image display device and a liquid crystal display device that is provided with a DAC that is capable of performing highly accurate digital-analog conversion that is free from influence from the load capacitances of signal lines.

It is another object of the present invention to provide an EL image display device and a liquid crystal display device that is provided with a DAC that does not entail increased circuit area at higher resolutions.

To achieve the above-described objects, the display device of the present invention is a display device in which a pixel matrix having a plurality of pixels arranged in matrix form and a data driver for supplying image signals to the pixel matrix are fabricated on the same substrate.

The pixel matrix includes one signal line for each column of pixels for supplying image signals and two scanning lines for each row of pixels for supplying scanning signals;

the data driver includes a plurality of serial digital/analog conversion circuits, one serial digital/analog conversion circuit being provided for every two of the signal lines, and each serial digital/analog conversion circuit using the parasitic capacitance of the two connected signal lines as two capacitances for charge distribution; and among the pixels that are connected to the two signal lines that are connected in common to each of the serial digital/analog conversion circuits, two pixels that are included in the same pixel row are each connected to mutually different scanning lines of the scanning lines that are provided in pairs for each pixel row.

In another display device of the present invention, the data driver is further provided with: a shift register having outputs that are equal in number to the number of signal lines; memories equal in number to the number of pixels that are included in a pixel row for sampling received digital image signals by means of the outputs of the shift register; and parallel/serial conversion circuits that are equal in number to the number of memories for successively supplying, for each bit starting from least significant bit of the image signals, signals that have been stored in the plurality of memories.

The serial digital/analog conversion circuits are provided for every two adjacent signal lines of the plurality of signal lines, and using the load capacitances of the two signal lines: successively convert data from, of the plurality of parallel/serial conversion circuits, parallel/serial conversion circuits that correspond to pixels of odd-numbered pixel columns, to analog data and apply this analog data to pixels of odd-numbered pixel columns; and successively apply data from, of the plurality of parallel/serial conversion circuits, parallel/serial conversion circuits that correspond to pixels of even-numbered pixel columns, to pixels of even-numbered pixel columns.

According to the present invention, the serial digital/analog conversion circuits use the load capacitances of two signal lines, which are the load, to perform DA conversion of signals from parallel/serial conversion circuits, and the source of error of the serial digital/analog conversion circuits is therefore determined only by the difference in capacitance between the two load capacitances, and the TFTs function only as simple switches.

Thus, even when the liquid crystal display device is constructed from polysilicon and the characteristics of the TFTs consequently vary, this variation does not cause output error of the serial digital/analog conversion circuit. The serial digital/analog conversion circuit can perform highly accurate DA conversion without the output voltage of the DAC being subject to influence by the load capacitance of signal lines.

In the present invention, moreover, the DAC components that perform DA conversion of image signals, which are digital data, use the configuration of a serial DAC that sequentially converts digital data that are serially transmitted, and the number of DAC components is therefore fixed regardless of the number of bits of image signals that are converted. Thus, an increase in the number of bits of received image signals results in an increase of only the memories and serial/parallel conversion circuits and does not lead to an increase in the DAC components.

Thus, higher numbers of bits can be handled with a smaller surface area than a liquid crystal display device of the prior art that uses a capacitance-array DAC. In other words, the number of capacitance arrays that are required is equal only to the number of bits of the image signal, which is digital data, and increasing the DAC resolution therefore does not result in an increase in the circuit area.

In addition, the gate drivers consist of a first and second gate driver that are provided with one on either side of the pixel matrix, and the two scanning lines may be driven by the first and second gate drivers in common, or may be independently driven by the first and second gate drivers, respectively.

Further, the liquid crystal display device is realized by constructing each of the pixels that make up the pixel matrix from a pixel transistor, a pixel capacitance, and a storage capacitance; wherein the gate terminal of the pixel transistor is connected to the scanning line, the source terminal of the pixel transistor is connected to the signal line, and the drain terminal of the pixel transistor is connected to the pixel capacitance and the storage capacitance.

An organic EL display device is realized by constructing each of the pixels that make up the pixel matrix from a plurality of transistors, an EL (Electro Luminescence) element, a storage capacitance, and a plurality of power supply lines.

Electronic paper is realized by constructing each of the pixels that make up the pixel matrix from a plurality of transistors and an electric ink pixel.

The above and other objects, features, and advantages of the present invention will become apparent from the following description with reference to the accompanying drawings, which illustrate examples of the present invention.

DETAILED DESCRIPTION OF THE PREFERRED EMBODIMENTS

First Embodiment:

The construction of the liquid crystal display device that is the first embodiment of the display device of the present invention is next explained with reference to FIG. 2. For the purpose of explanation, the number of data bits of image signals V0–V5 is taken as six bits.

Figure 2:
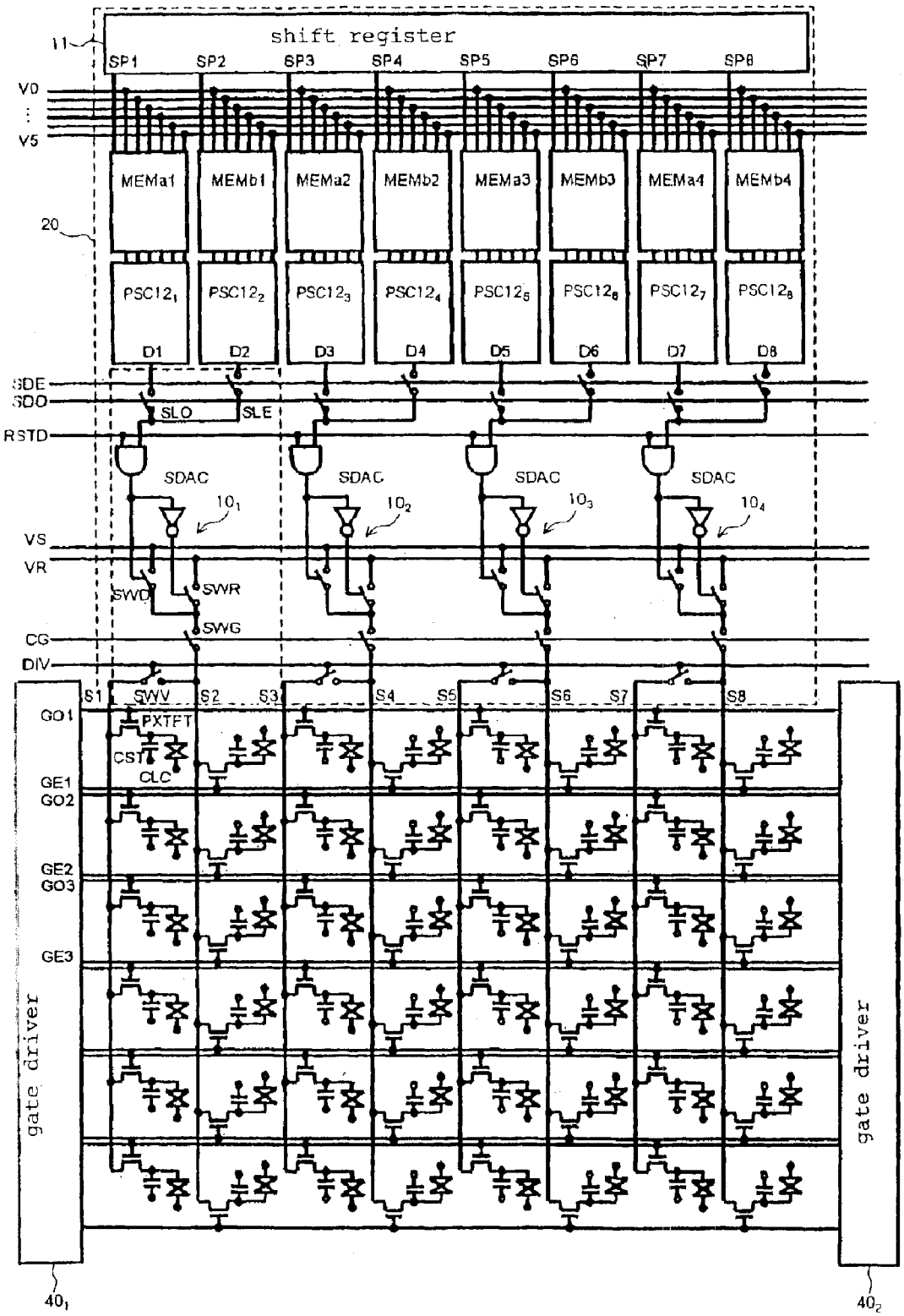
FIG. 2 is a block diagram showing the construction of a liquid crystal display device that is a display device of the first embodiment of the present invention.

Referring now to FIG. 2, the liquid crystal display device of this embodiment consists of: pixel matrix in which a plurality of pixels are arranged in a matrix; data driver 20 for driving signal lines that are connected to the source terminals of the pixel TFTs of each pixel; and gate drivers $\mathbf{40}_1$ and $\mathbf{40}_2$ for driving the scanning lines that are connected to the gate terminals of the pixel TFTs. The pixel matrix consists of pixel TFTs, which are active elements for each pixel, and liquid crystal capacitance and storage capacitance that are connected to the drain terminals of the pixel TFTs. In the pixel matrix, moreover, one signal line is arranged for each pixel column, and two scanning lines are arranged for each pixel row, one scanning line being connected to the pixels of odd-numbered pixel columns and the other scanning line being connected to the pixels of even-numbered pixel columns.

In addition, data driver 20 consists of: shift register 11 having outputs equal or greater in number than the number of signal lines; memories MEMa1–MEMa4 and MEMb1–MEMb4 for sampling digital image signals that are provided as output from shift register 11; parallel/serial conversion circuits (PSC) $\mathbf{12}_1$–$\mathbf{12}_8$ for successively supplying to SDAC $\mathbf{10}_1$–$\mathbf{10}_4$ the signals that have been stored in memories MEMa1–MEMa4 and MEMb1–MEMb4; and SDAC $\mathbf{10}_1$–$\mathbf{10}_4$ for each bit, one of SDAC $\mathbf{10}_1$–$\mathbf{10}_4$ being provided for every two lines of the eight signal lines D1–D8. Gate drivers $\mathbf{40}_1$ and $\mathbf{40}_2$ each consist of a shift register having outputs equal to or greater in number than the number of pixel rows and a decoder for splitting the output of the shift register.

The liquid crystal display device of the present embodiment has special features with regard to the construction of SDAC $\mathbf{10}_1$–$\mathbf{10}_4$ and the construction of the pixel matrix.

Each of SDAC $\mathbf{10}_1$–$\mathbf{10}_4$ in the present embodiment: is provided for two adjacent signal lines of the plurality of signal lines, and using the load capacitance of these two signal lines, successively converts to analog data the data from the parallel/serial conversion circuits that correspond to the pixels of odd-numbered pixel columns of PSC $\mathbf{12}_1$–$\mathbf{12}_8$ and applies this converted data to pixels of odd-numbered pixel columns; and successively applies data from the parallel/serial conversion circuits that correspond to pixels of even-numbered pixel columns to pixels of even-numbered pixel columns.

Figure 3:
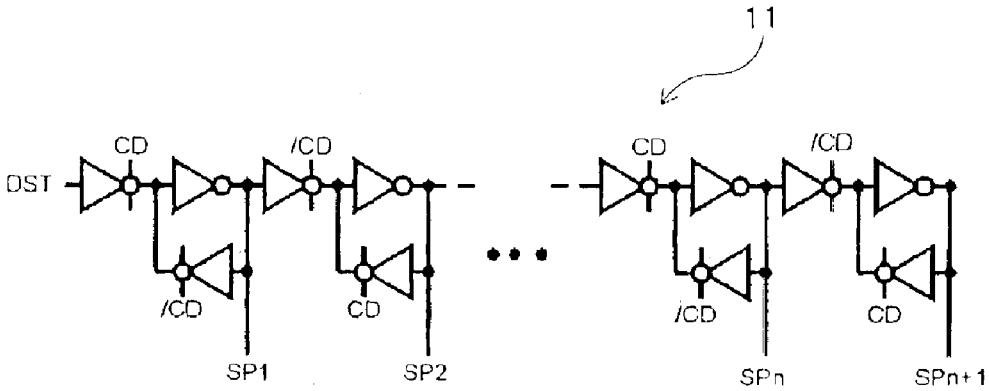
FIG. 3 is a circuit diagram showing the configuration of shift register 11 in FIG. 2.

Actual embodiments of each of the principal circuits that are used in data driver 20 and gate drivers $\mathbf{40}_1$ and $\mathbf{40}_2$ are next described. FIG. 3 is a circuit diagram showing an example of shift register 11 that makes up data driver 20, this shift register 11 consisting of two clocked inverters and one inverter for each output terminal. This shift register circuit 11 is controlled by two clock signals CD and /CD of different phase and start signal DST.

Figure 4:
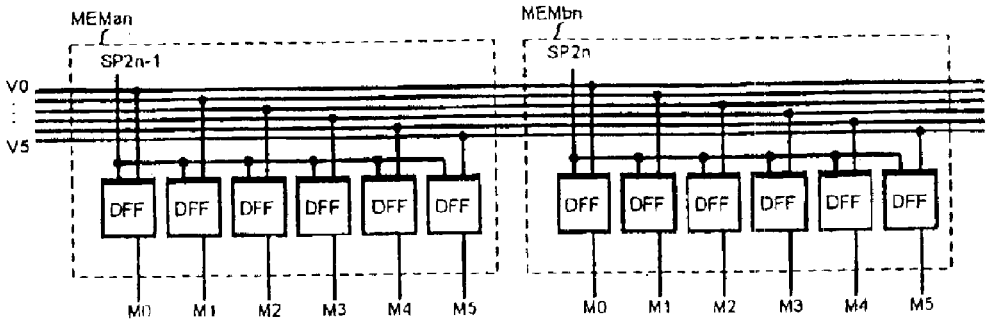
FIG. 4 shows the configuration of memories MEMa1–MEMa4 and MEMb1–MEMb4 in FIG. 2.

FIG. 4 is a circuit diagram showing an example of memories MEMan and MEMbn (where n=1–4) that make up data driver 20. These memories MEMan and MEMbn perform an operation of latching in DFF (D flip-flops) image signals V0–V5 that are supplied from the outside in accordance with the output signals SP (2*n*) and SP (2*n*−1) of shift register 11.

Figure 5:
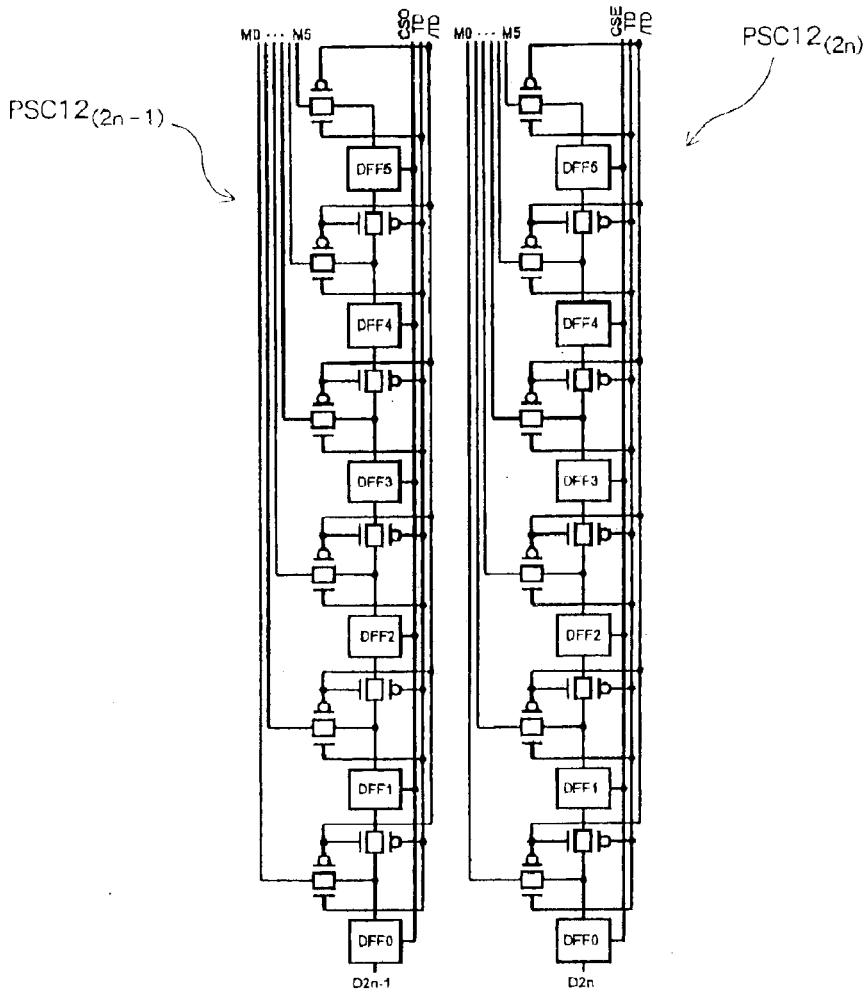
FIG. 5 is a circuit diagram showing the configuration of PSC (parallel/serial conversion circuits) $\mathbf{12}_1$–$\mathbf{12}_8$ in FIG. 2.

FIG. 5 is a circuit diagram showing an example of parallel/serial conversion circuits (PSC) $\mathbf{12}_1$–$\mathbf{12}_8$, these parallel/serial conversion circuits operating by transmitting the outputs of memories MEMan and MEMbn to the serially connected DFF and successively supplying this output. The data transmission from memories MEMan and MEMbn is controlled by control signals TD and /TD; and the sequential output of data is controlled by clock signals CSO and CSE. Clock signal CSO controls the odd-numbered PSC of the two PSC that are connected to a single SDAC, and clock signal CSE controls the even-numbered PSC.

Figure 6:
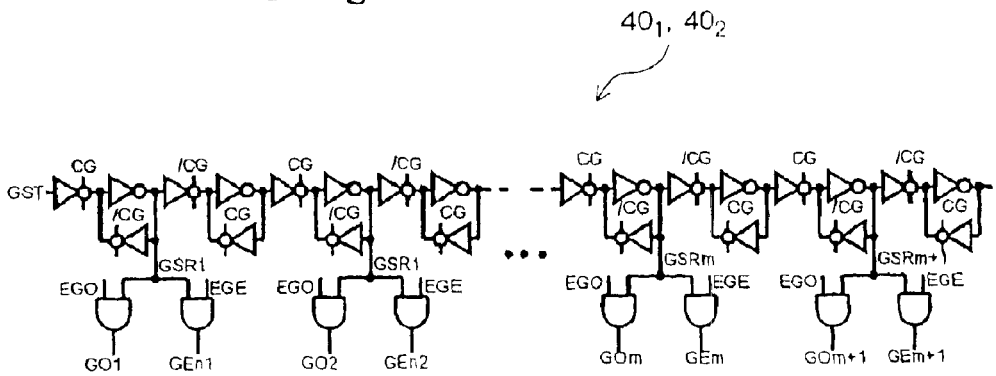
FIG. 6 is a circuit diagram showing the configuration of gate drivers $\mathbf{40}_1$ and $\mathbf{40}_2$ in FIG. 2.

FIG. 6 is a circuit diagram showing an example of gate drivers $\mathbf{40}_1$ and $\mathbf{40}_2$; these gate drivers $\mathbf{40}_1$ and $\mathbf{40}_2$ each consisting of: a shift register that is controlled by two clock signals CG and /CG and start signal GST; and a decoder circuit that is made up by two AND circuits for dividing into two branches the output of the shift register in accordance with control signals EGO and EGE. The operation of the liquid crystal display device of the present embodiment is next described in detail with reference to the Figures.

Figure 7:
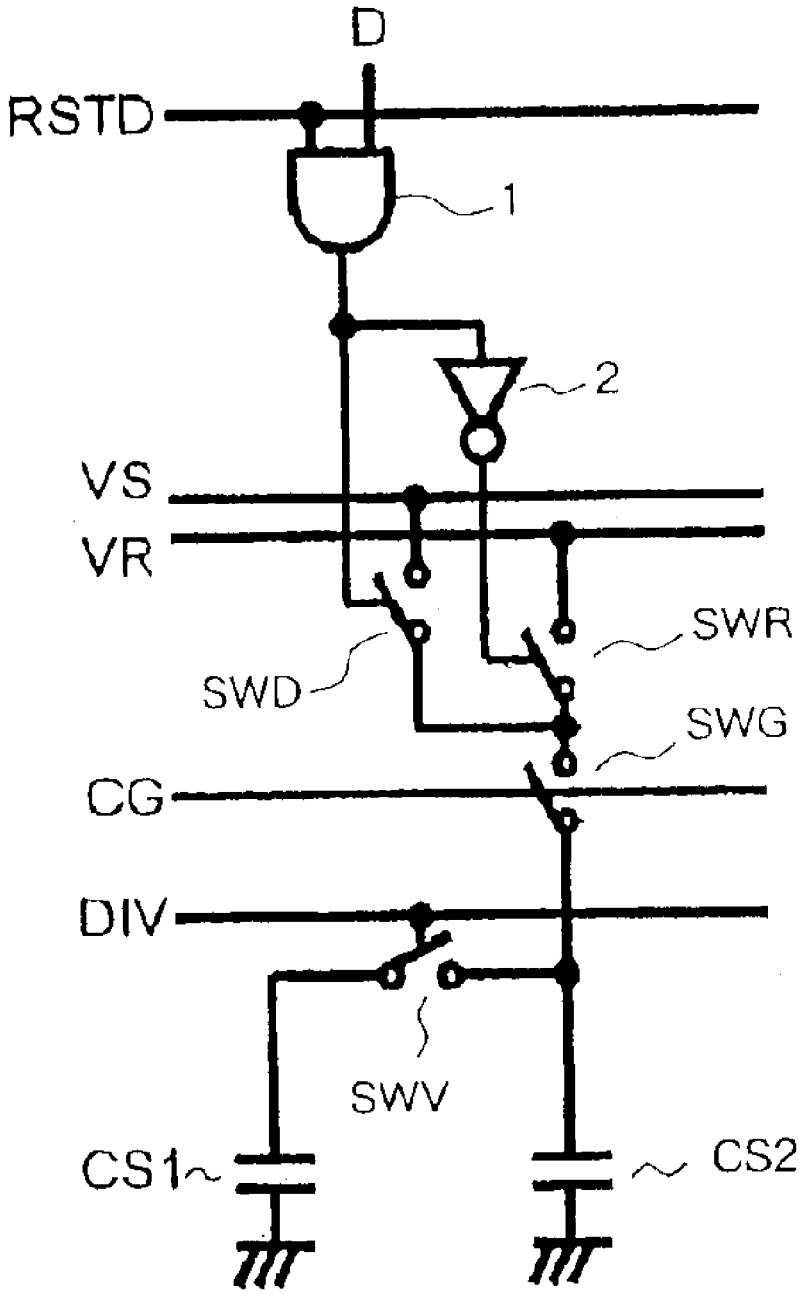
FIG. 7 shows the equivalent circuit of one circuit portion of SDAC $\mathbf{10}_1$–$\mathbf{10}_4$ in FIG. 2.

As an explanation of the operation of the liquid crystal display device of the present embodiment, the operation of SDAC $\mathbf{10}_1$–$\mathbf{10}_4$ will first be explained using an equivalent circuit and a timing chart. FIG. 7 shows the equivalent circuit of a one-circuit portion of SDAC $\mathbf{10}_1$–$\mathbf{10}_4$. SDAC 10, consists of: two switches SLO and SLE for selecting one of the outputs of two PSC $\mathbf{12}_1$ and $\mathbf{12}_2$; AND circuit 1 for receiving as input the output from switches SLO and SLE and control signal RSTD; switch SWD that is controlled by the output of AND circuit 1; inverter 2 for inverting the logic of the output of AND circuit 1; switch SWR that is controlled by the output of inverter 2; switch SWG that is controlled by control signal CG; and switch SWV that is connected to switch SWG and two signal lines and that is controlled by control signal DIV.

The terminals of switch SWD are connected to power supply line VS and switch SWG, respectively; and the terminals of switch SWR are connected to power supply line VR and switch SWG, respectively. The other terminal of switch SWG is connected to one of the two signal lines that are connected to the DAC. Each of the two terminals of switch SWV is connected to a respective signal line of the two signal lines that are connected to the DAC. In the pixel matrix, two scanning lines are provided for each pixel row as previously described, and as a feature of the connections of these scanning lines and gate terminals of the pixel TFT, one of two adjacent pixel columns that are connected to a single DAC is connected to one of the above-described scanning lines, and the other is connected to a different scanning line.

Figure 8:
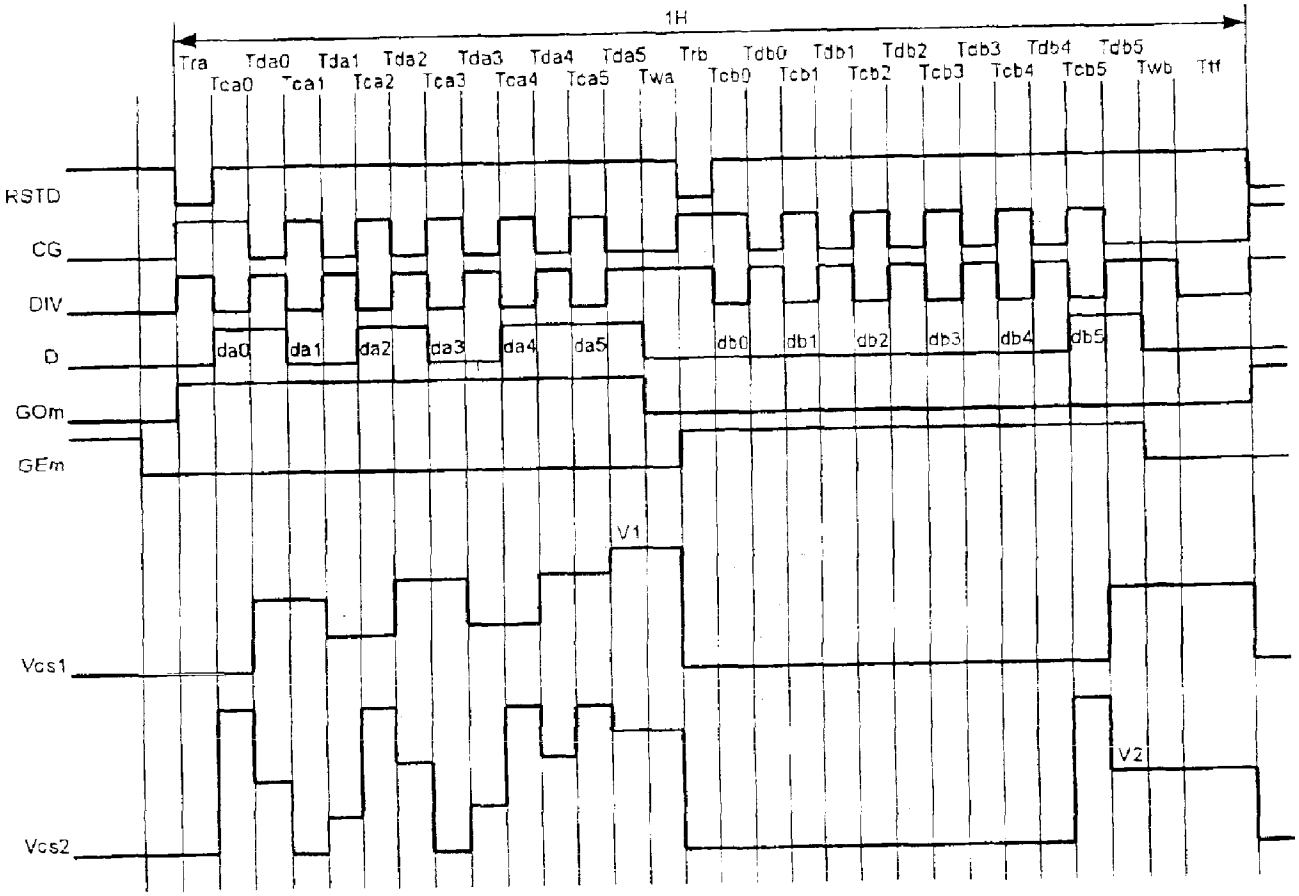
FIG. 8 is a timing chart for explaining the operation of SDAC shown in FIG. 7.

The two load capacitances CS1 and CS2 that are connected to switch SWV in FIG. 7 represent the load capacitances of the two signal lines, which are the load of SDAC $\mathbf{10}_1$, and D, which is the input terminal of this circuit, represents the output from PSC $12_1$–$12_8$. In this case, the values of capacitances CS1 and CS2 are equal. FIG. 8 shows a timing chart for explaining the operation. In this Figure, explanation is given for a specific example in which the six-bit signal "110101" is received from D-terminal and subjected to DA conversion.

Assuming that 1H is one horizontal time interval for displaying the image signals of a one-row portion of a liquid crystal panel on the pixel matrix, operation in this SDAC is divided into: intervals (Tra-Twa) for writing signals to odd-numbered pixel columns, intervals (Trb-Twb) for writing signals to the even-numbered pixel columns, and the interval (Ttf) for transmitting signals from memories MEMan and MEMbn to PSC $12_1$–$12_8$. First, in interval Tra, the RSTD signal becomes low level, whereby the output of AND circuit 1 becomes low level regardless of data D, the output of inverter 2 becomes high level, switch SWD turns OFF, and switch SWR turns ON. In addition, control signals CG and DIV both become high level, whereby switches SWG and SWV both turn ON. The voltage of power supply line VR is written to both load capacitances CS1 and CS2, and the capacitances are thus reset.

Next, in interval Tca0, the least significant bit signal da0 that has been digitized is received as input by this circuit at terminal D. At this time, signal da0 is high level and control signals RSTD, CG, and DIV are high level, high level, and low level, respectively, whereby switch SWD turns ON, switch SWR turns OFF, and switch SWV turns OFF, and the voltage of power supply line VS is written to load capacitance CS2 in FIG. 7.

In interval Tda0, CG becomes low level and DIV becomes high level, and as a result, switch SWG turns OFF, switch SWV turns ON, and the charge that was written to load capacitance CS2 in interval Tca0 passes by way of switch SWV to be delivered to load capacitance CS1, whereby the voltages Vcs1 and Vcs2 of the two load capacitances CS1 and CS2, respectively, become values that are expressed by the following formula (1):

$$Vcs1=Vcs2=\tfrac{1}{2}\times(VS-VR) \quad (1)$$

The next bit of data da1 is similarly converted in intervals Tca1 and Tda1, and this operation is repeated up to da5, which is the highest-order bit of data. In other words, when signal dan that is received as input from terminal D is high level, the voltage of power supply line VS is written to load capacitance CS2 and the charges that have been written to load capacitance CS1 and load capacitance CS2 are then balanced by means of switch SWV; and when signal dan that has been received as input from terminal D is low level, the voltage of power supply line VR is written to load capacitance CS2 and the charges that have been written to load capacitance CS1 and load capacitance CS2 are then balanced by means of switch SWV. After these process are repeated successively, voltage of the two load capacitances CS1 and CS2 in interval Tda5, respectively, become values that are expressed by the following formula (2):

$$Vcs1=Vcs2=\Sigma(2^{-n}\times Dan)\times(VS-VR) \quad (2)$$

Here, Dan is nth significant bit, this being either "0" or "1". In addition, in the example shown here, "0" is the low level of terminal D and "1" is the high level.

In short, the n bits of digital data (in this case, six bits) that are sequentially received as input at terminal D are converted to analog values and voltages are written to the two load capacitances CS1 and CS2. In this case, gate signal GOm for controlling the pixel TFTs of the odd-numbered pixel columns is high level from interval Tra until interval Tda5 and changes to low level at the start of interval Twa, and the voltage of Vcs1 is therefore written to the pixels of odd-numbered pixel columns.

Similarly, the sequential input of image signals Db0–Db5 that have been digitized to even-numbered pixel columns in the time interval from Trb to Twb causes the voltages Vcs1 and Vcs2 of the two load capacitances CS1 and CS2 to become the values shown by the following formula (3):

$$Vcs1=Vcs2=\Sigma(2^{-n}\times Dbn)\times(VS-VR) \quad (3)$$

Here, Dbn is nth significant bit, this being either "0" or "1". In addition, in the example shown here, "0" is the low level of terminal D and "1" is the high level.

In this interval, gate signal GEm for controlling the pixel TFTs of even-numbered pixel columns is high level from interval Trb until interval Tdb5 and switches to low level at the start of interval Twb, and as a result, the voltage of Vcs2 is written to the pixels of even-numbered pixel columns.

Figure 9:
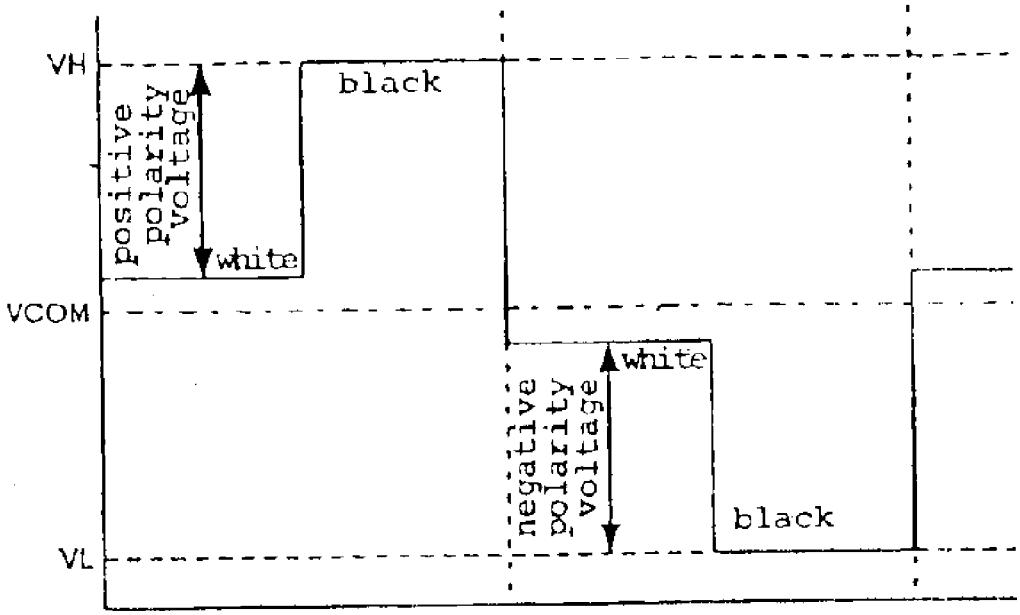
FIG. 9 shows the relation between VCOM, VH, and VL and image signals that are applied to a liquid crystal pixel.

In this case, when voltage line VR is the opposing electrode potential VCOM of the liquid crystal display device and the voltage that is written to pixels is a voltage that is higher than VCOM (voltage of positive polarity), setting power supply line VS to voltage VH, which is the highest voltage that is applied to the liquid crystal pixels, allows an analog voltage of positive polarity to be written to pixels. Similarly, when writing a voltage that is lower than VCOM (a voltage of negative polarity), making power supply line VR the same potential as VCOM and setting power supply line VS to voltage VL, which is the lowest voltage applied to the liquid crystal pixels, allows an analog voltage of negative polarity to be written to pixels. FIG. 9 shows the relation between the image signals that are applied to liquid crystal pixels and VCOM, VH, and VL.

Analog-converted voltages are written to odd-numbered pixel columns and even-numbered pixel columns in one horizontal interval by the above-described operations, and repeating these operations for the number of pixel rows enables the writing of analog-converted image signals to the entire pixel matrix.

The overall operation of data driver 20 is next described using timing charts. Generally, when driving a liquid crystal, the continuous application of direct current, in which polarity is fixed, has a negative effect on the liquid crystal such as degradation of the quality of the liquid crystal. To prevent such unwanted effects, an alternating current drive method is adopted in which drive is implemented by an alternating current obtained by inverting the polarity of the applied voltage at prescribed timings. In this case, an example is shown in which a scanning line inversion drive is implemented as the mode of the alternating current drive of the liquid crystal. Methods for realizing other inverted drive modes will be explained later.

Figure 10:
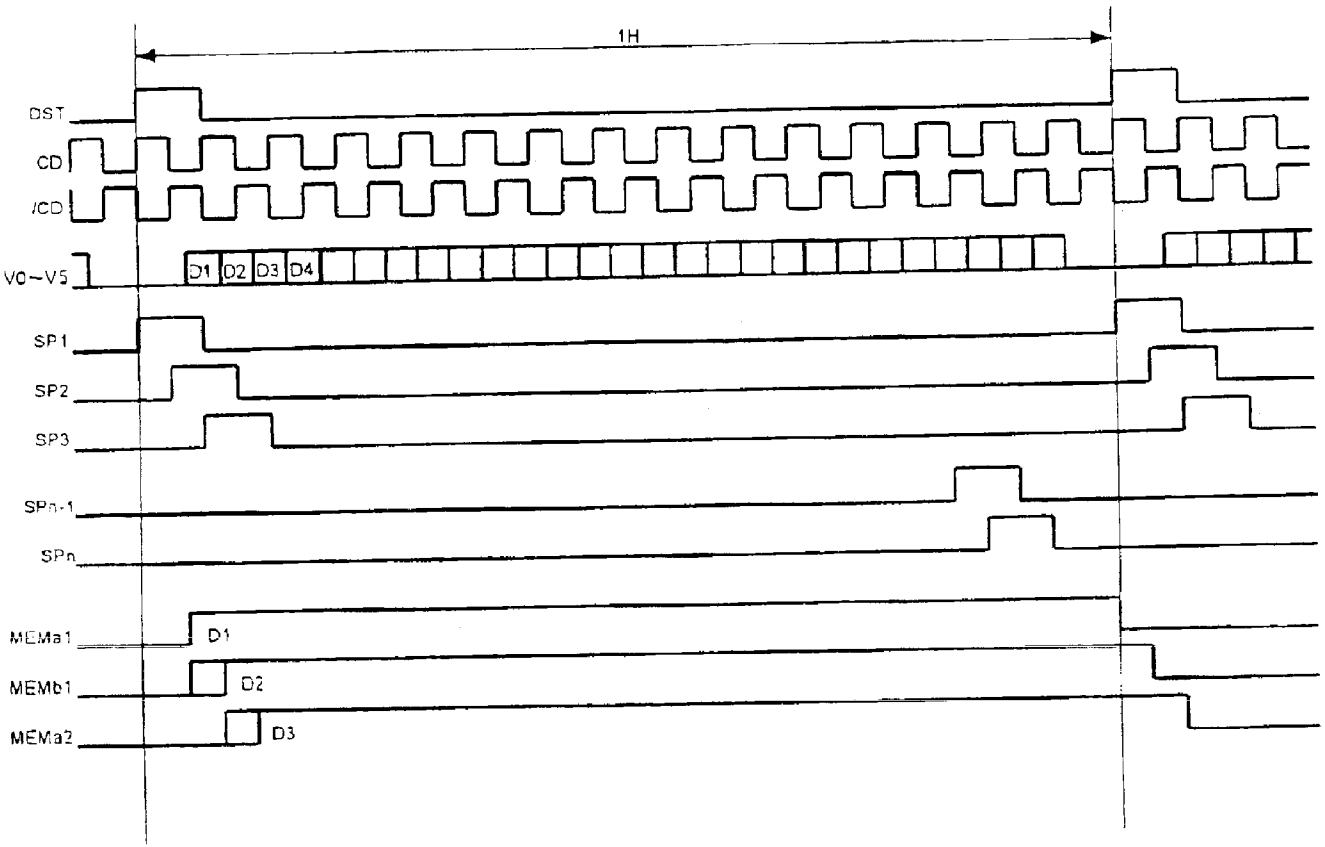
FIG. 10 is a timing chart showing the operation of shift register 11, which is a constituent element of data driver 20.

FIG. 10 is a timing chart showing the operation of shift register 11, which is a constituent element of data driver 20. This shift register 11 is controlled by means of start signal DST and clock signals of two phases CD and /CD. Start signal DST is supplied as a pulse with a period of one horizontal interval (1H), and the clocks are pulses having the same frequency as image signals V0–V5. After start signal DST changes to high level, each of outputs SP1–SP(n+1) of shift register 11 shown in FIG. 3 sequentially supplies pulses of the same length as the clock period in the order of SP1, SP2, and so on. These pulses are supplied as clock signals of the DFFs of memories MEMan and MEMbn shown in FIG. 4, whereby image signals are successively sampled in portions of one pixel row in the order of memories MEMa1, MEMb1, MEMa2, and so on as shown in FIG. 2.

Figure 11:
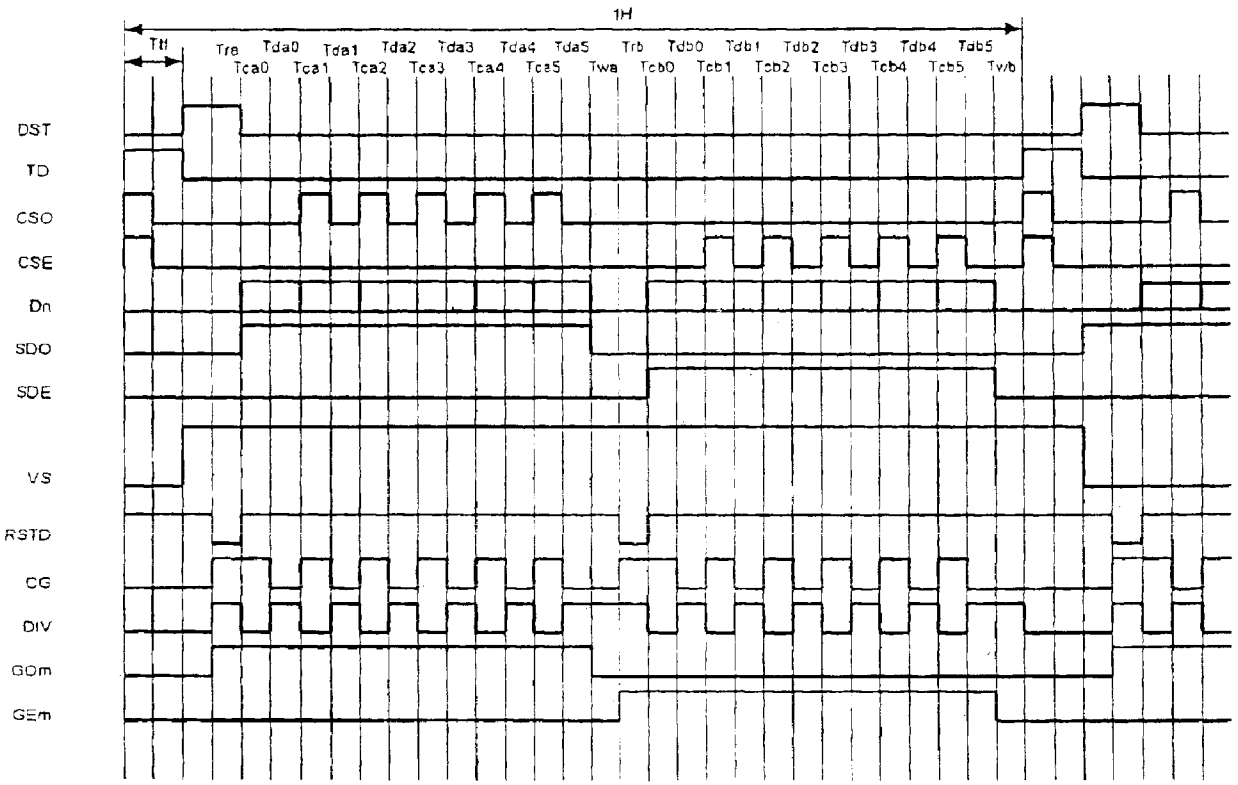
FIG. 11 is a timing chart showing the operation of PSC $\mathbf{12}_1$–$\mathbf{12}_8$ and SDAC $\mathbf{10}_1$–$\mathbf{10}_4$.

FIG. 11 is a timing chart showing the operation of PSC $\mathbf{12}_1$–$\mathbf{12}_8$ and SDAC $\mathbf{10}_1$–$\mathbf{10}_4$. In interval Ttf, the control signal TD of PSC $\mathbf{12}_1$–$\mathbf{12}_8$ first becomes high level, and during this time pulse signals CSO and CSE are applied, whereby the data for one pixel row that are held in memories MEMan and MEMbn are all simultaneously transmitted to PSC $\mathbf{12}_1$–$\mathbf{12}_8$. Next come the intervals identified by the symbols Tra-Twa in which image signals are written to odd-numbered pixel columns. In these intervals, signals SDO and SDE for switching the output of PSC $\mathbf{12}_1$–$\mathbf{12}_8$ become high level and low level, respectively; whereby switch SLO turns ON and switch SLE turns OFF, and the output of PSC $\mathbf{12}_{(2n-1)}$ (where n is a positive natural number) is connected to SDAC $\mathbf{10}_1$–$\mathbf{10}_4$. The operation of SDAC $\mathbf{10}_1$–$\mathbf{10}_4$ during this interval has already been explained, and explanation will here be limited to the transmission of data from PSC $\mathbf{12}_1$–$\mathbf{12}_8$ to SDAC $\mathbf{10}_1$–$\mathbf{10}_4$.

The data destined for odd-numbered pixel columns are held in memory MEMan. In the preceding data transmission interval Ttf, these data were transmitted to PSC $\mathbf{12}_{(2n-1)}$, and the data destined for odd-numbered pixel columns are therefore held in PSC $\mathbf{12}_{(2n-1)}$. Here, PSC $\mathbf{12}_{(2n-1)}$ that holds data destined for odd-numbered pixel columns is driven by a control signal that differs from that of PSC $\mathbf{12}_{(2n)}$ that similarly holds data destined for even-numbered pixel columns, and during this interval, the control signal CSO of PSC $\mathbf{12}_{(2n-1)}$ becomes high level only during intervals Tca1, Tca2, . . . , Tca5. Thus, in interval Tca0, the least significant bit signal Da0 that was transmitted at the time of interval Ttf is held in DFF0, and the output of PSC $\mathbf{12}_{(2n-1)}$ therefore becomes Da0. Similarly, in interval Tcal, the change of CSO to high level causes the data of DFF0–DFF5 to each be shifted, whereby the data of DFF0 becomes Da1 and the output of PSC $\mathbf{12}_{(2n-1)}$ becomes Da1. The output of PSC $\mathbf{12}_{(2n-1)}$ similarly becomes Da2 in Tca2, and as shown in the Figure, the image signal data of odd-numbered pixel columns that is held in MEMa $(2n-1)$ are successively supplied from the lowest-order bits as the output of PSC $\mathbf{12}_{(2n-1)}$. Image signals are consequently written to selected pixels of odd-numbered pixel columns.

In the intervals indicated by Trb-Twb in which data of even-numbered pixel columns are written, SDO and SDE become low level and high level, respectively, whereby switch SLO turns OFF, switch SLE turns ON, and the output of PSC $\mathbf{12}_{(2n)}$ is connected to SDAC $\mathbf{10}_1$–$\mathbf{10}_4$. As with the interval for writing to odd-numbered pixel columns, control signal CSE of PSC $\mathbf{12}_{(2n)}$ becomes high level only in the intervals Tcb1, Tcb2, . . . , Tcb5, whereby data from Db0 to Db5 are successively supplied to SDAC $\mathbf{10}_1$–$\mathbf{10}_4$ in the intervals from interval Tcb0 to Tcb5, as shown in the Figure. Image signals are thus written to selected pixels of even-numbered pixel columns.

Figure 12:
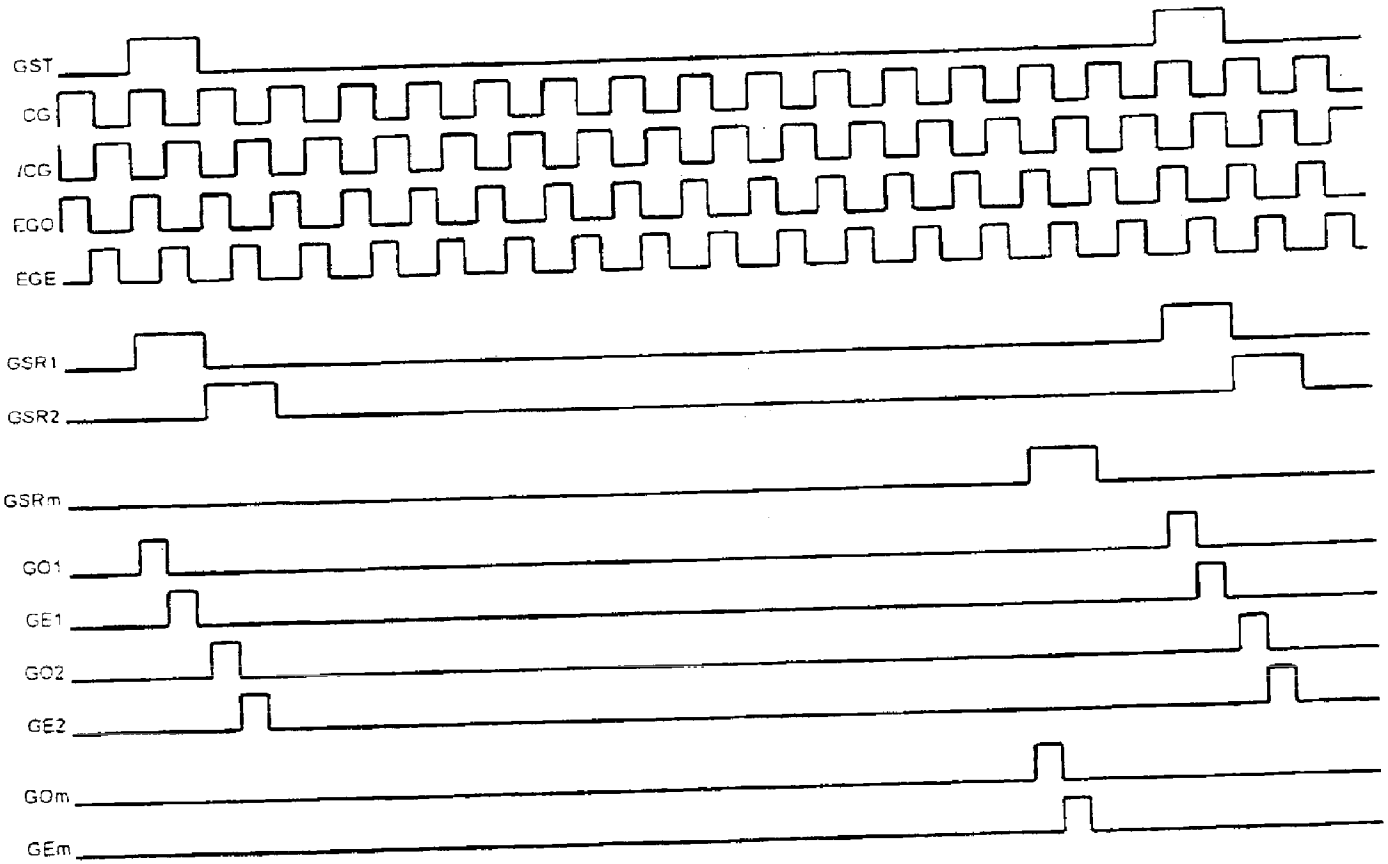
FIG. 12 is a timing chart showing the operation in a construction in which gate drivers $\mathbf{40}_1$ and $\mathbf{40}_2$ shown in FIG. 6 are arranged to the left and right of the pixel matrix.

The operation of gate drivers $\mathbf{40}_1$ and $\mathbf{40}_2$ is next described. FIG. 12 is a timing chart in a construction in which gate drivers $\mathbf{40}_1$ and $\mathbf{40}_2$ shown in FIG. 6 are arranged on the left and right of the pixel matrix. GST is a start pulse of the shift registers that make up the gate drivers, one start pulse GST being supplied in the interval 1V that is required for writing image signals to the entire pixel matrix. CG and /CG are clock signals of the shift register 11 and are pulses having a period of 1H. EGO and EGE are control signals of the decoder circuit for splitting the output of the shift register 11. When start pulse GST becomes high level, shift register 11 successively supplies pulses having a width of 1H in synchronization with clock CG in the order of GSR1 and GSR2. In the decoder circuit, the output of the shift register is subject to time division in accordance with control signals EGO and EGE, and as a result, pulses are successively supplied to scanning lines GOm and GEm. Here, as shown in FIG. 11, scanning lines GOm that are connected to the gate terminals of pixel TFTs of odd-numbered pixel columns and scanning lines GEm that are connected to the gate terminals of pixel TFTs of even-numbered pixel columns must become high level only during intervals Tca0–Tda5 and intervals Tcb0–Tdb5, and the intervals in which control signals EGO and EGE become high level are therefore made to be the same as the previous intervals.

The operation according to the foregoing explanation causes data that are received as digital data input in a liquid crystal panel to be successively written to pixels, thereby enabling writing of a two-dimensional image.

In this construction, moreover, frame inversion, scanning line inversion, signal line inversion, and dot inversion can be implemented as inverted drive modes for implementing alternating-current drive of the liquid crystal. The timing charts for implementing each type of drive are shown in FIGS. 13–18.

Figure 13:
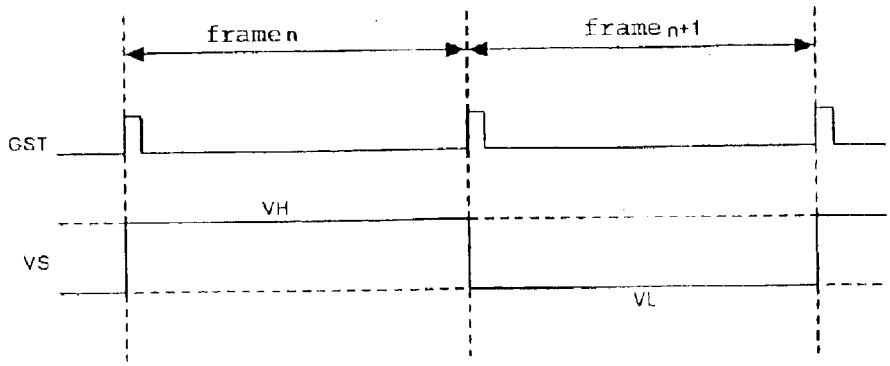
FIG. 13 is a timing chart of power supply line VS when implementing frame inversion drive.

FIG. 13 shows a timing chart of power supply line VS when realizing frame inversion drive, the voltage of power supply line VS switching between VL and VH with each frame, whereby the polarity that is written to pixels differs in frame units, whereby frame inversion drive can be realized.

Figure 14:
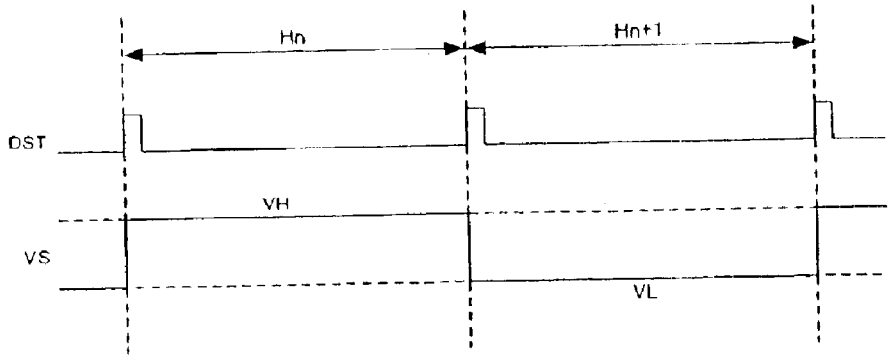
FIG. 14 is a timing chart showing the change in power supply line VS when writing signals of the nth and (n+1)th rows of odd-numbered frames when implementing scanning line inversion drive.
Figure 15:
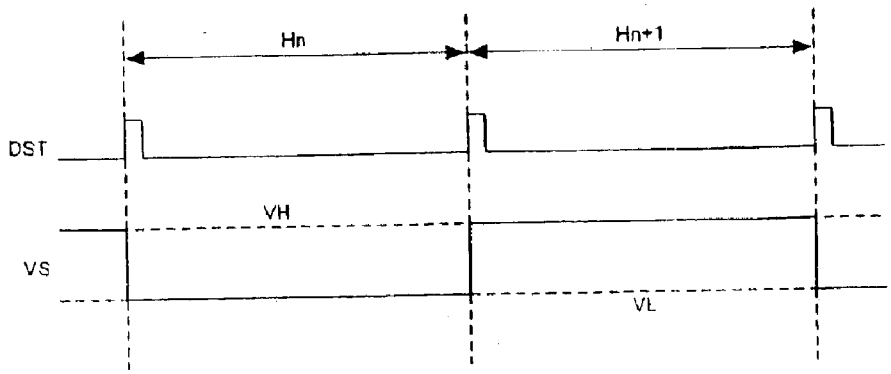
FIG. 15 is a timing chart showing the change in power supply line VS when writing signals of the nth and (n+1)th rows of even-numbered frames when implementing scanning line inversion drive.

FIGS. 14 and 15 show timing charts of VS when realizing scanning line inversion drive. FIG. 14 is the timing chart for a case of writing the signals of the nth and (n+1)th rows of odd-numbered frames, the voltage of power supply line VS switching between VL and VH with each horizontal interval. Here, the voltage is VH in the nth row and VL in the (n+1)th row. FIG. 15 is the timing chart for a case of writing signals of the nth and (n+1)th rows of even-numbered frames, the voltage being VL in the nth row and VH in the (n+1)th row, which is the reverse of the case for odd-numbered frames. By this operation, the polarity that is written to pixels for each row alternates in units of single frames, and when viewed from frame to frame, rows in which signals of positive polarity are written alternate with rows in which signals of negative polarity are written, whereby scanning line inversion drive can be realized.

Figure 16:
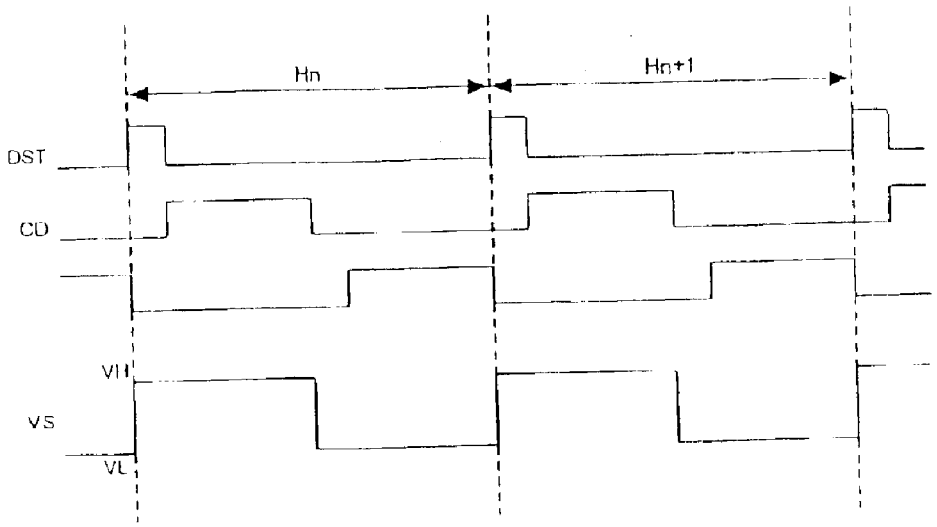
FIG. 16 is a timing chart showing the operation when writing image signals to the nth and (n+1)th rows of odd-numbered frames when implementing signal line inversion drive.
Figure 17:
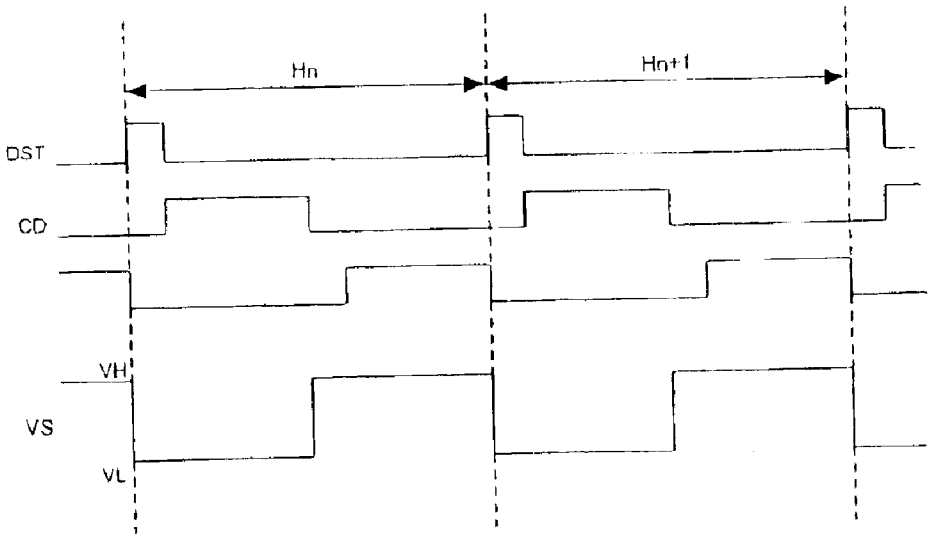
FIG. 17 is a timing chart showing operation when writing image signals to the nth and (n+1)th rows of even-numbered frames when implementing signal line inversion drive.

FIGS. 16 and 17 show timing charts for cases of implementing signal line inversion drive. FIG. 16 is the timing chart for a case of writing image signals to the nth and (n+1)th rows of odd-numbered frames, power supply line VS being made VH in the first half of one horizontal interval, i.e., when writing to odd-numbered pixel columns; and power supply line VS being made VL in the second half of one horizontal interval, i.e., when writing to even-numbered frames. FIG. 17 is a timing chart for a case of writing image signals to the nth and (n+1)th rows of even-numbered frames, power supply line VS being made VL in the first half of one horizontal interval and power supply line VS being made VH in the second half. By means of this operation, the polarity differs for each pixel column in one-frame units, and when viewed between frames, columns in which signals of positive polarity are written alternate with columns in which signals of negative polarity are written, whereby signal line inversion drive can be realized.

Figure 18:
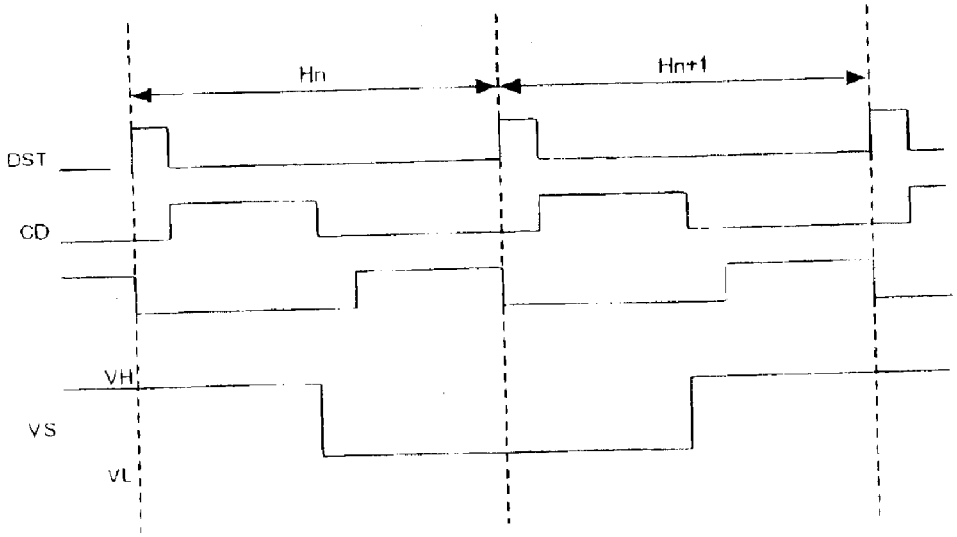
FIG. 18 is a timing chart showing the operation when writing image signals to the nth and (n+1)th rows of odd-numbered frames when implementing dot inversion drive.
Figure 19:
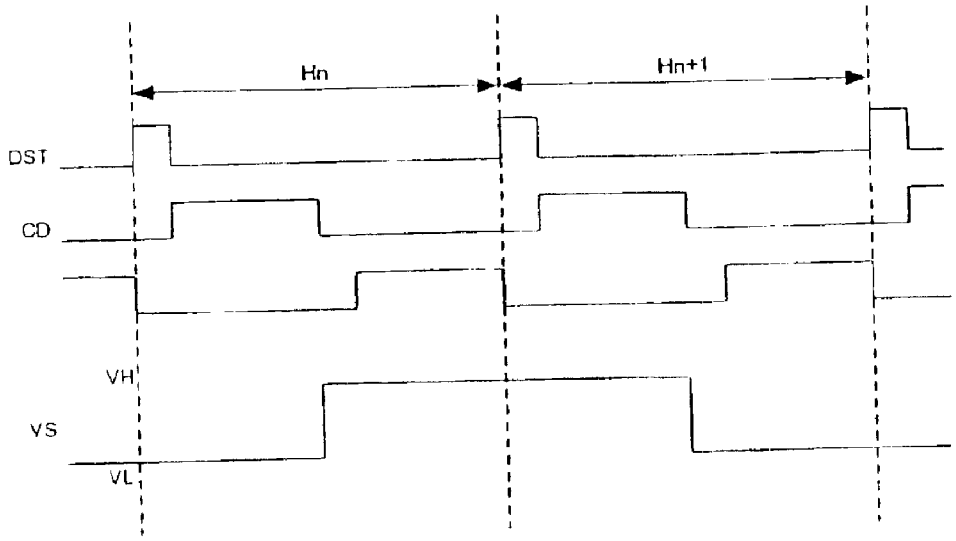
FIG. 19 is a timing chart showing operation when writing image signals to the nth and (n+1)th rows of even-numbered frames when implementing dot inversion drive.

FIGS. 18 and 19 show timing charts when implementing dot inversion drive. FIG. 18 is a timing chart for a case of writing image signals to the nth and (n+1)th rows of odd-numbered frames, power supply line VS being made VH in the first half of the nth row, i.e., when writing image signals to odd-numbered pixel columns, and power supply line VS being made VL in the second half of the nth row, i.e., when writing image signals to the even-numbered pixel columns. In the (n+1)th row, power supply line VS is made VL in the first half, and power supply line VS is made VH in the second half. In this way, a signal of positive polarity is written to odd-numbered pixel columns and a signal of negative polarity is written to even-numbered pixel columns in the nth row; and conversely, negative polarity is written to odd-numbered pixel columns and positive polarity is written to even-numbered pixel columns in the (n+1)th row. FIG. 19 is the timing chart for a case of writing image signals to the nth and (n+1)th rows of even-numbered frames, wherein power supply line VS is made VL in the first half and power supply line VS is made VH in the second half of the nth row, while power supply line VS is made VH in the first half and power supply line VS is made VL in the second half of the (n+1)th row. Thus, in contrast to odd-numbered frames, signals of negative polarity are written to odd-numbered pixel columns and signals of positive polarity are written to even-numbered pixel columns of the nth row, and positive polarity is written to odd-numbered pixel columns and negative polarity is written to even-numbered pixel columns of the (n+1)th row, whereby dot inversion drive can be realized.

As described in the foregoing explanation, the load capacitances CS1 and CS2 of two signal lines, which are the load, are used to realize DA conversion of signals from PSC $\mathbf{12}_1$–$\mathbf{12}_8$ by SDAC $\mathbf{10}_1$–$\mathbf{10}_4$ in the liquid crystal display device of the present embodiment. The source of error of SDAC $\mathbf{10}_1$–$\mathbf{10}_4$ is determined by the difference in capacitance of load capacitances CS1 and CS2 of the two signal lines that are the load of the SDAC, and the TFTs operate only as simple switches. Thus, even when the liquid crystal display device is constructed from polysilicon and the characteristics of the TFTs vary, this variation does not act as a source of output error of SDAC $\mathbf{10}_1$–$\mathbf{10}_4$. In addition, the signal line load capacitances CS1 and CS2 that are the source of output error are formed at the intersections of signal lines and other lines in the pixel matrix or with the conductive films of, for example, BM (black matrix). As a result, the error is canceled over the entire pixel matrix despite the occurrence of superposed error resulting from PR processing in minute regions, and almost no error occurs in the size of load capacitances on adjacent signal lines. The liquid crystal display device of the present embodiment therefore enables highly accurate digital-analog conversion when using polysilicon TFTs having great fluctuation in characteristics.

Further, the DAC portion that performs digital-analog conversion of image signals, which are digital data, in the liquid crystal display device of the present embodiment employs a serial DAC construction that successively converts digital data that are transmitted in serially, and the DAC portion is therefore uniform regardless of the number of converted bits. As a result, increasing the number of bits of image signals that are received as input results in an increase of only the memories and SPC. Thus, when the bit number is increased, the present embodiment enables digital-analog conversion in a smaller area than a liquid crystal display device of the prior art that uses a capacitance-array DAC. In other words, the present embodiment can realize multi-bit DAC in a small area.

Figure 20:
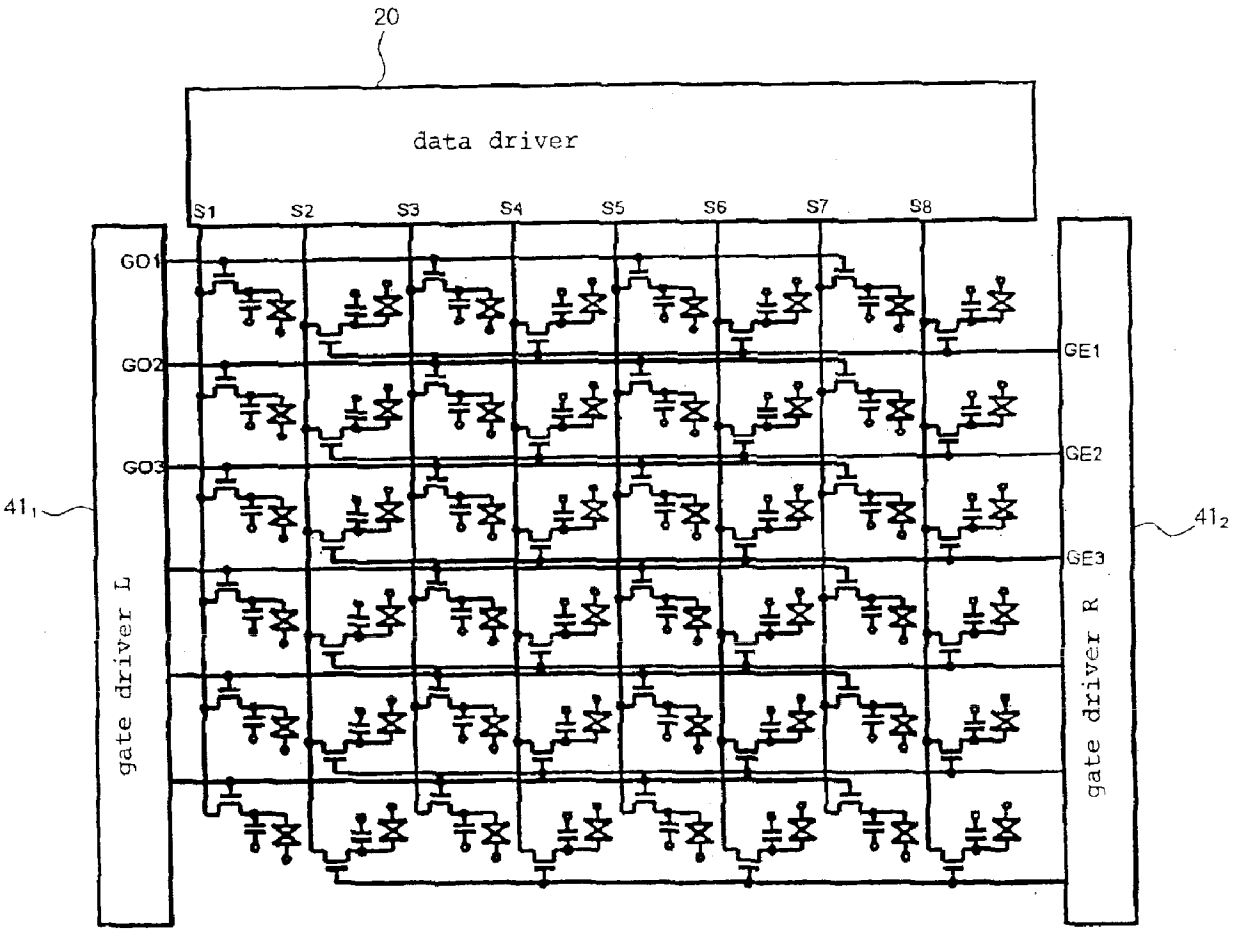
FIG. 20 is a block diagram showing the construction of a liquid crystal display device, which is the display device of the second embodiment of the present invention.

Second Embodiment:

Explanation next regards the liquid crystal display device that is the second embodiment of the present invention. We first refer to FIG. 20, which is a block diagram showing the construction of the liquid crystal display device of the second embodiment of the present invention. In FIG. 20, constituent elements that are identical to constituent elements in FIG. 2 are identified by the same reference numerals, and redundant explanation is omitted.

Figure 21:
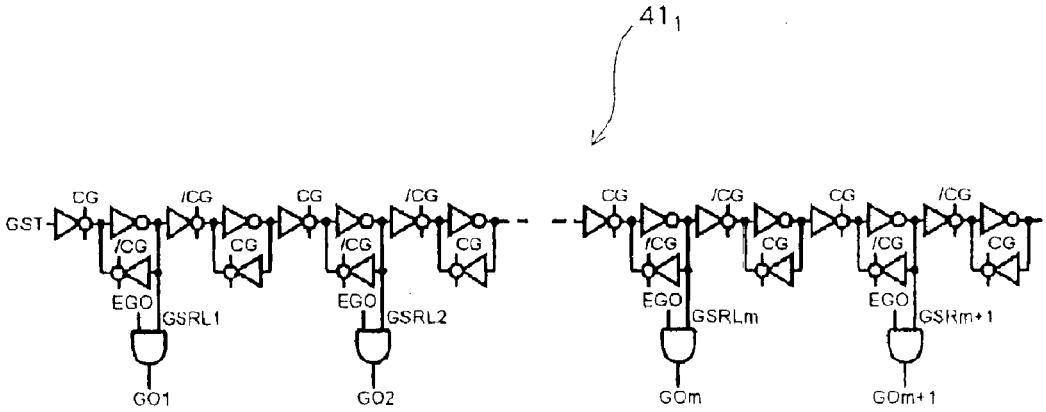
FIG. 21 is a circuit diagram showing the configuration of gate driver $\mathbf{41}_1$, in FIG. 20.
Figure 22:
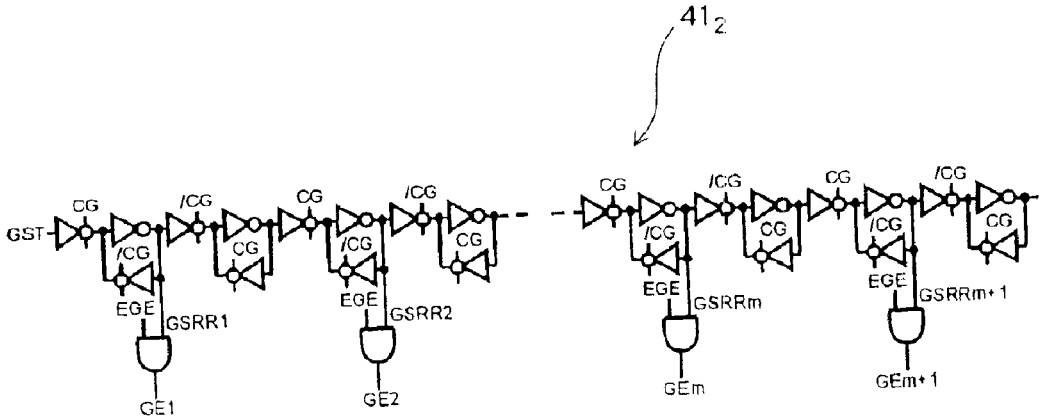
FIG. 22 is a circuit diagram showing the configuration of gate driver $\mathbf{41}_2$ in FIG. 20.

In the liquid crystal display device of the first embodiment that was previously described, all scanning lines are common to and driven by two gate drivers $\mathbf{40}_1$ and $\mathbf{40}_2$ that are arranged to the left and right of the pixel matrix; but as shown in FIG. 20, the two scanning lines GO and GE that are provided for each pixel row may each be independently driven by two gate drivers $\mathbf{41}_1$ and $\mathbf{41}_2$ that are provided to the left and right of the pixel matrix. In this case, the two gate drivers $\mathbf{41}_1$ and $\mathbf{41}_2$ can be realized by the circuits shown in FIGS. 21 and 22. Gate drivers $\mathbf{41}_1$ and $\mathbf{41}_2$ that are shown in FIGS. 21 and 22 function to wave-shape the output of shift register circuits by means of an AND circuits and control signals EGO or EGE. In the example shown here, pixel TFTs of odd-numbered pixel columns are driven by the gate driver that is arranged on the left side of the pixel matrix, and pixel TFTs of the even-numbered pixel columns are driven by the gate driver that is arranged on the right side, but a construction that is the reverse of this arrangement is also possible.

The details of the operation of the liquid crystal display device of this embodiment are next explained with reference to the Figures.

Figure 23:
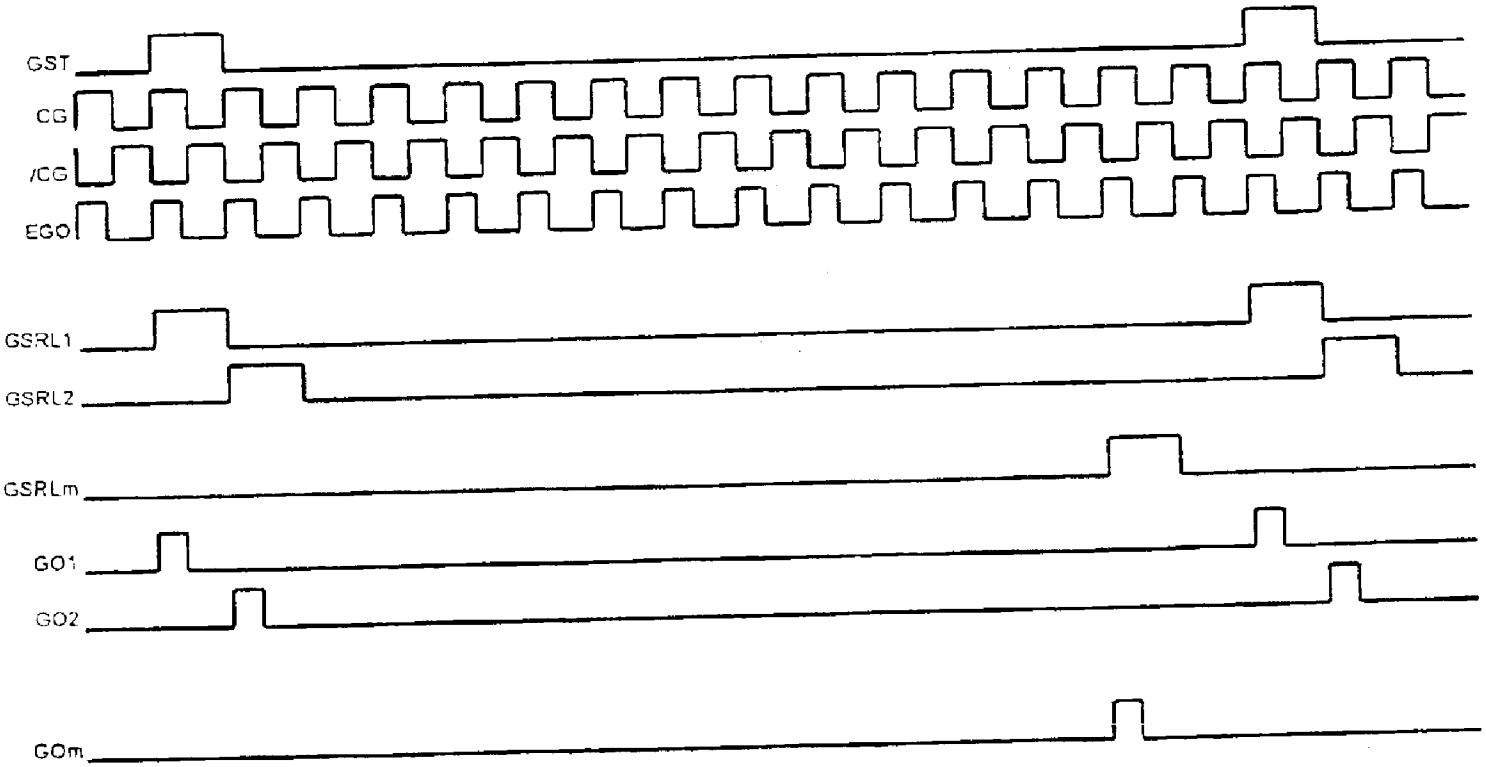
FIG. 23 is a timing chart showing the operation of gate driver $\mathbf{41}_1$ that is arranged on the left side of the pixel matrix.
Figure 24:
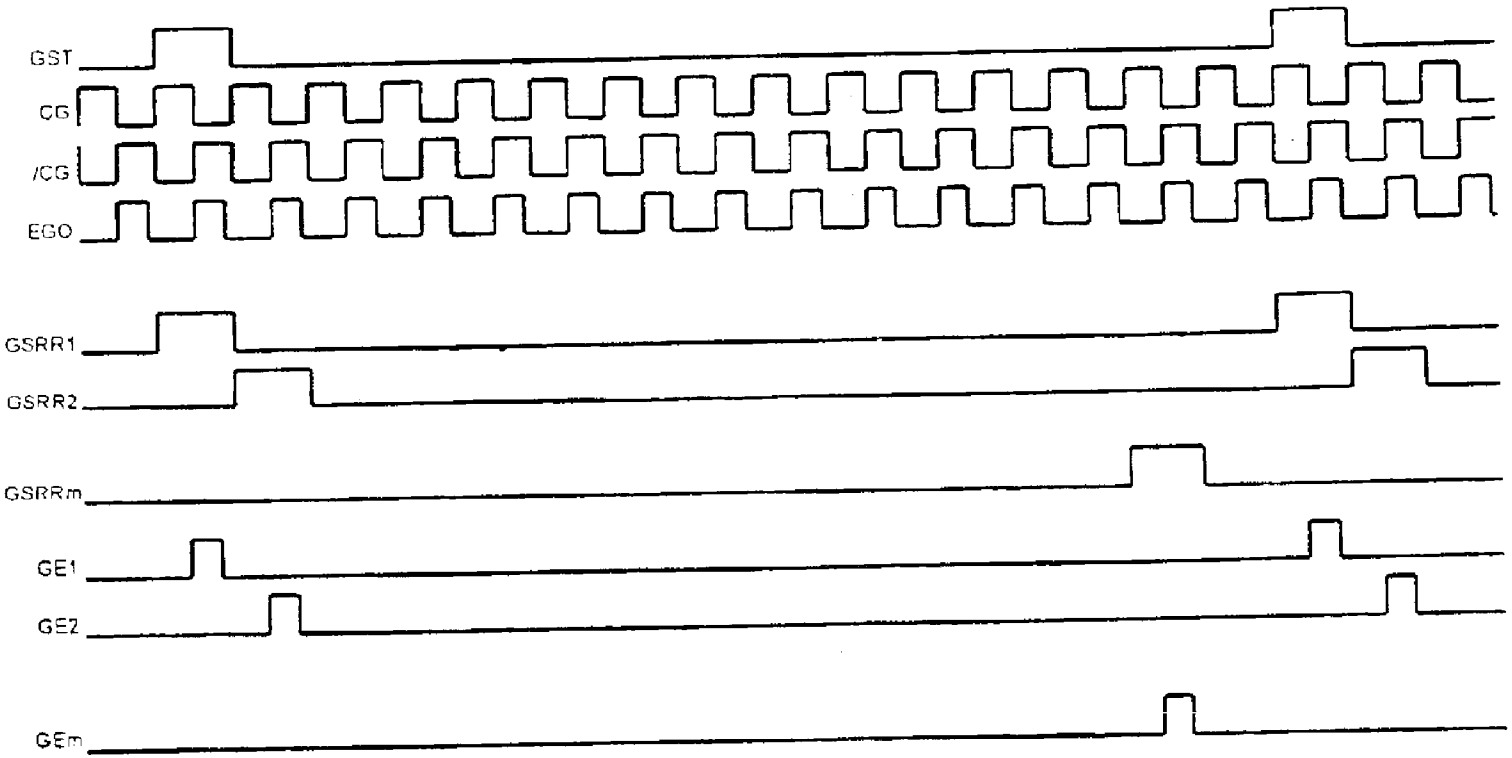
FIG. 24 is a timing chart showing the operation of gate driver $\mathbf{41}_2$ that is arranged on the right side of the pixel matrix.

The operation of the liquid crystal display device of this embodiment is substantially the same as the operation of the liquid crystal display device of the previously explained first embodiment. The only point of difference is the drive method of two gate drivers $\mathbf{41}_1$ and $\mathbf{41}_2$ that are arranged to the left and right. FIG. 23 is a timing chart of gate driver $\mathbf{41}_1$ that is arranged on the left side of the pixel matrix, and FIG. 24 is a timing chart of gate driver $\mathbf{41}_2$ that is arranged on the right side. The gate drivers are controlled by start pulse GST, clocks CG and /CG, and decoder signals EGO and EGE. Although start pulse GST and clocks CG and /CG are here used in common by the two gate drivers $\mathbf{4}_1$ and $\mathbf{41}_2$, decoder signal EGO is used only by gate driver $\mathbf{41}_1$ on the left side, and EGE is used only by gate driver $\mathbf{41}_2$ on the right side. Left-side gate driver $\mathbf{41}_1$ thus drives the scanning lines that are connected to the gate terminals of pixel TFTs of odd-numbered pixel columns, and right-side gate driver $\mathbf{41}_2$ drives the scanning lines that are connected to the gate terminals of pixel TFTs of the even-numbered pixel columns.

Figure 1:
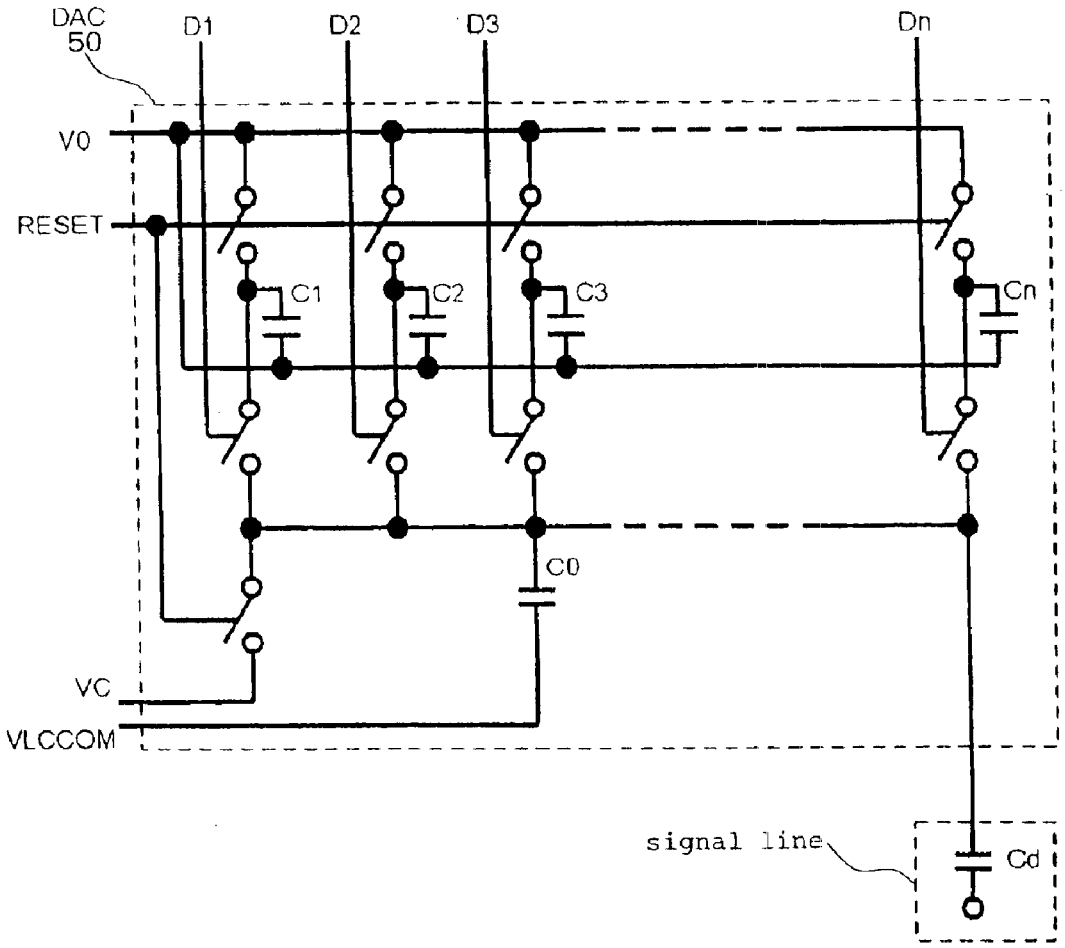
Fig. 1 PRIOR ART
FIG. 1 is a block diagram showing the construction of DAC 50 that is provided in a liquid crystal display device of the prior art.
Figure 25:
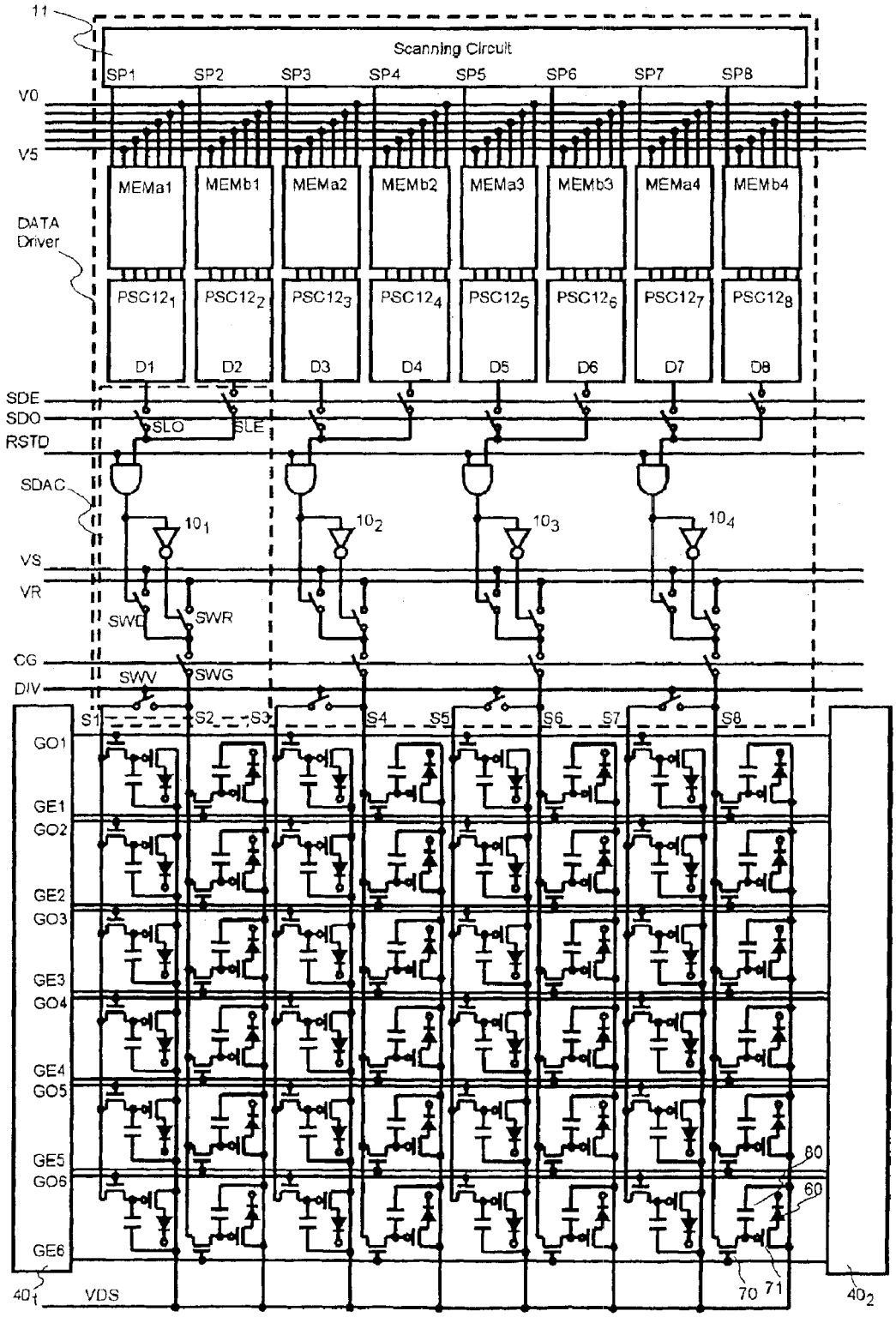
FIG. 25 is a block diagram showing the configuration of an organic EL image display device, which is the display device of the third embodiment of the present invention.

Third Embodiment:

An EL image display device, which is the display device of the third embodiment of the present invention, is next explained. FIG. 25 is a block diagram showing the construction of the EL display device of the third embodiment of the present invention. In FIG. 25, constituent elements that are identical to constituent elements in FIG. 1 are identified by the same reference numerals, and redundant explanation is here omitted.

In the liquid crystal display device of the first embodiment that was previously described, an example was described in which each of the pixels that make up the pixel matrix consists of a liquid crystal pixel. The EL display device that is the third embodiment, however, is an example of an EL image display device in which each pixel is made up by transistors, EL elements, and storage capacitance. FIG. 25 shows an example in which each of these pixels is made up by: two transistors, first transistor 70 and second transistor 71; EL element 60; and storage capacitance 80. The source terminal of the first transistor is connected to a signal line, the gate terminal is connected to one of two scanning lines that are provided for each pixel row, and the drain terminal is connected to the storage capacitance and the gate terminal of the second transistor. The second transistor has its drain terminal connected to power supply line VDS that is common to all pixels, and has its source terminal connected to the anode terminal of the EL element. The cathode terminal of the EL element is connected to the power supply line that is common to all pixels that are not shown in the Figure. The other terminal of the storage capacitance is connected to power supply line VDS. In this case, an NMOS is used as the first transistor, and a PMOS is used as the second transistor, but either NMOS or PMOS may be used for each transistor. However, when an NMOS is used as the second transistor, the connection with the EL element changes to the cathode side.

The first transistor and second transistor in the above explanation of the third embodiment can be replaced by TFTs when the EL image display device of the present embodiment is fabricated on a glass substrate. In this case, a large-area EL image display device can be realized.

The operation of the EL image display device of the present embodiment is next described.

The basic operation of the present embodiment, which is to convert digital image signals to analog signals by serial DAC and successively write to signal lines, is not different from that of the first embodiment. In the case of a liquid crystal display device, however, analog image signals that are written to signal lines are written to the liquid crystal capacitance and storage capacitance by pixel TFTs, and the voltage of the analog image signals that are held alters the alignment of liquid crystal molecules to realize display. In the case of an EL image display device, the analog image signals that are written to signal lines are written to storage capacitance by first transistors, and the held voltage controls the current that flows through the second transistors to control the amount of light that is emitted by the EL elements.

Figure 26:
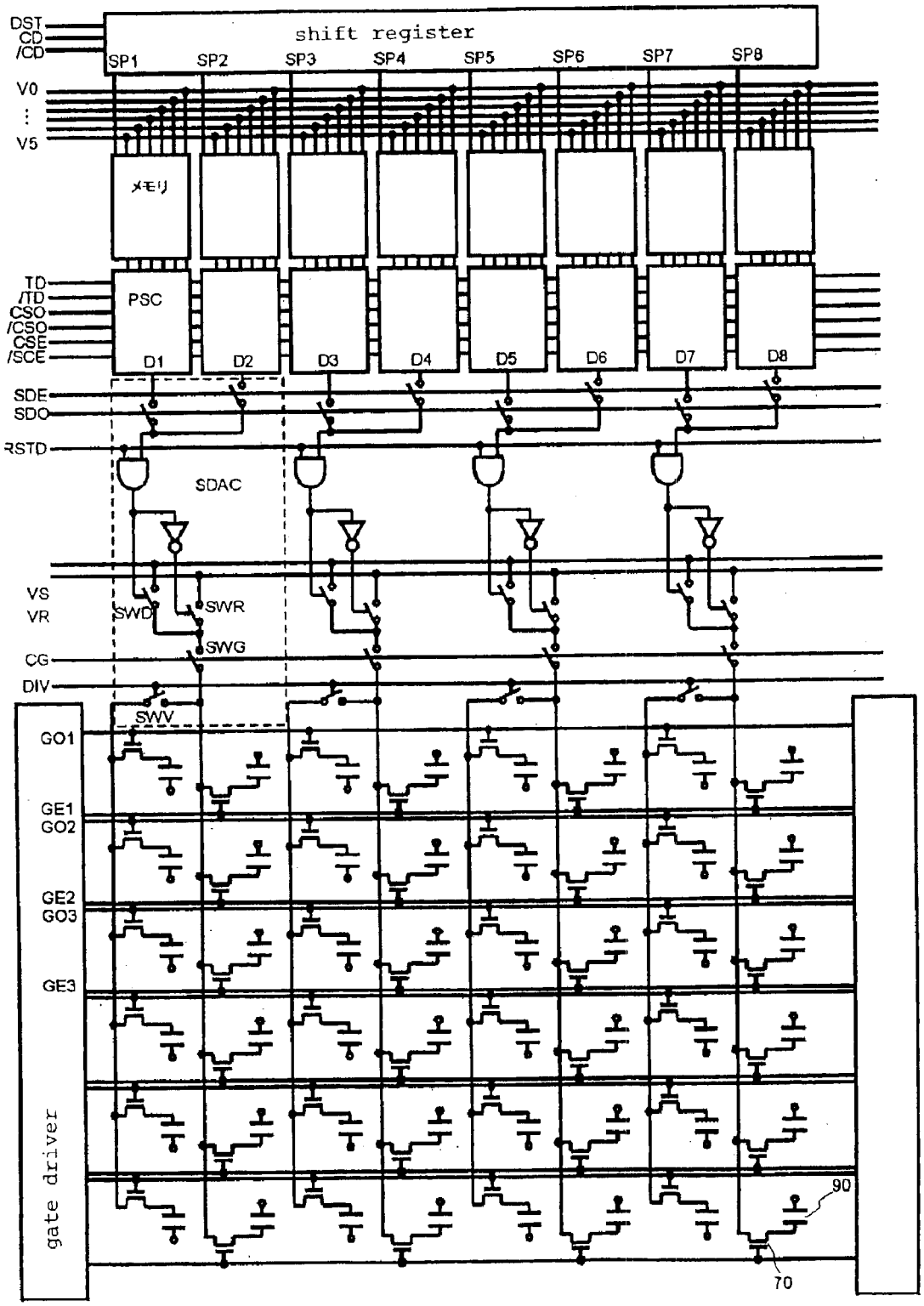
FIG. 26 is a block diagram showing the configuration of electronic paper, which is the display device of the fourth embodiment of the present invention.

Fourth Embodiment:

Explanation next regards electronic paper, which is the display device of the fourth embodiment of the present invention. FIG. 26 is a block diagram showing the construction of electronic paper of the fourth embodiment of the present invention. In FIG. 26, constituent elements that are identical to constituent elements in FIG. 1 are identified by the same reference numerals, and redundant explanation is here omitted.

In the liquid crystal display device of the first embodiment that was previously described, a case was shown in which each of the pixels that make up the pixel matrix is made up by a liquid crystal pixel, but electronic paper, which is the fourth embodiment, is an example of realizing electronic paper in which each pixel is made up by a pixel transistor and an electronic ink pixel. FIG. 26 shows an example in which each of these pixels is made up by pixel transistor 70 and electronic ink pixel 90. The pixel transistor has its source terminal connected to a signal line, its gate terminal connected to one of two scanning lines that are provided for each pixel row, and its drain terminal connected to the electronic ink pixel. The other terminal of the electronic ink pixel is connected to a power supply line (not shown in the Figure) that is common to all of pixels. As the electronic ink, various methods can be applied such as a method in which display is realized by attracting two types of fine particles that are dyed in different colors by electrophoresis to different respective electrodes, or a method in which spheres are divided into two colors and these spheres then rotated.

In the above explanation describing the fourth embodiment, the pixel transistor can be replaced by TFTs when the electronic paper of the present embodiment is fabricated on a glass substrate or a plastic substrate. In such a case, electronic paper having a large area can be realized.

Next, regarding the operation of the electronic paper of the present embodiment, the basic operation of this embodiment, which is to convert digital image signals to analog signals by serial DAC and then successively write to signal lines is not different from that of the above-described first embodiment. The analog signals that are written to signal lines are held in electronic ink pixels by means of pixel transistors, and the electronic ink display changes by means of the voltage of these analog signals to obtain a two-dimensional image.

While preferred embodiments of the present invention have been described using specific terms, such description is for illustrative purposes only, and it is to be understood that changes and variations may be made without departing from the spirit or scope of the following claims.

What is claimed is:

1. A display device in which a pixel matrix having a plurality of pixels arranged in matrix form and a data driver for supplying image signals to said pixel matrix are fabricated on the same substrate;

wherein:

said pixel matrix comprises one signal line for each column of pixels for supplying image signals and two scanning lines for each row of pixels for supplying scan signals;

said data driver comprises a plurality of serial digital/analog conversion circuits, one serial digital/analog conversion circuit being provided for every two of said signal lines, and each serial digital/analog conversion circuit using parasitic capacitance of said two connected signal lines as two capacitances for charge distribution; and among pixels that are connected to said two signal lines that are connected in common to each of said serial digital/analog conversion circuits, two pixels that are included in the same pixel row are each connected to mutually different scanning lines of said scanning lines that are provided in pairs for each pixel row.

2. A display device according to claim 1, wherein said data driver further comprises:

a shift register having outputs that are equal in number to the number of signal lines;

memories equal in number to the number of pixels that are included in a pixel row for sampling received digital image signals by means of the outputs of said shift register; and parallel/serial conversion circuits that are equal in number to the number of said memories for successively supplying, for each bit starting from least significant bit of the image signals, signals that have been stored in said plurality of memories;

wherein said serial digital/analog conversion circuits are provided for every two adjacent signal lines of said plurality of signal lines, and using the load capacitance of the two signal lines, successively convert data from, of said plurality of parallel/serial conversion circuits, parallel/serial conversion circuits that correspond to pixels of odd-numbered pixel columns, to analog data and apply this analog data to pixels of odd-numbered pixel columns; and successively apply data from, of said plurality of parallel/serial conversion circuits, parallel/serial conversion circuits that correspond to the pixels of even-numbered pixel columns, to pixels of even-numbered pixel columns.

3. A display device according to claim 1, wherein said plurality of serial digital/analog conversion circuits each comprise:

a first switch for selecting one of the outputs of two parallel/serial conversion circuits;

an AND circuit for receiving output from said first switch and a first control signal;

a second switch having one terminal connected to a first power supply line and that is controlled by output of said AND circuit;

an inverter for inverting logic of the output of said AND circuit;

a third switch having one terminal connected to a second power supply line and that is controlled by output of said inverter;

a fourth switch having one terminal connected to the other terminal of said second switch and to the other terminal of said third switch, having the other terminal connected to one of the two signal lines, and that is controlled by a second control signal; and a fifth switch having two terminals each connected to a respective one of said two signal lines and that is controlled by a third control signal.

4. A display device according to claim 1, wherein a gate driver for driving said scanning lines is arranged to one side of said pixel matrix on the same substrate as said pixel matrix.

5. A display device according to claim 2, wherein a gate driver for driving said scanning lines is arranged to one side of said pixel matrix on the same substrate as said pixel matrix.

6. A display device according to claim 1, wherein two gate drivers for driving said scanning lines are arranged, one on either side of said pixel matrix, and on the same substrate as said pixel matrix.

7. A display device according to claim 2, wherein two gate drivers for driving said scanning lines are arranged, one on either side of said pixel matrix, and on the same substrate as said pixel matrix.

8. A display device according to claim 6, wherein one of said two gate drivers drives one of said two scanning lines that are provided for each pixel row, and the other said gate driver drives the other said scanning line.

9. A display device according to claim 7, wherein one of said two gate drivers drives one of said two scanning lines that are provided for each pixel row, and the other said gate driver drives the other said scanning line.

10. A display device according to claim 1, wherein:

each pixel that makes up said pixel matrix comprises: a pixel transistor, a pixel capacitance, and a storage capacitance;

the gate terminal of said pixel transistor is connected to a said scanning line, and the source terminal of said pixel transistor is connected to a said signal line; and the drain terminal of said pixel transistor is connected to said pixel capacitance and said storage capacitance.

11. A display device according to claim 1, wherein each pixel that makes up said pixel matrix comprises: a plurality of transistors, an EL (Electro Luminescence) element, storage capacitance, and a plurality of power supply lines.

12. A display device according to claim 1, wherein each pixel that makes up said pixel matrix comprises: a plurality of transistors, and an electric ink pixel.

13. A display device drive method for driving a display device according to claim 1, said method comprising steps of:

transmitting signals from each of said memories to said parallel/serial conversion circuits; when, as a time interval for writing signals to pixels of odd-numbered pixel columns, the signal that is supplied from a parallel/serial conversion circuit that corresponds to the pixels of odd-numbered pixel columns is high level, writing the voltage of said first power supply line to one of the load capacitances of said two signal lines and then balancing the charges that has been written to said two load capacitances; and when the signal that is supplied from said parallel/serial conversion circuit is low level, writing the voltage of said second power supply line to one of the load capacitances of said two signal lines and then balancing the charges that have been written to said two load capacitances;

after the process of writing the voltage of a first or a second power supply line to said two load capacitances and balancing the charges has been completed for all bits that make up an image signal, applying the voltage of said load capacitances to each pixel of odd-numbered pixel columns;

when, as a time interval for writing signals to pixels of even-numbered pixel columns, the signal that is supplied from a parallel/serial conversion circuit that corresponds to the pixels of even-numbered pixel columns is high level, writing the voltage of said first power supply line to one of the load capacitance of said two signal lines and then balancing the charges that have been written to said two load capacitances; and when the signal that is supplied from said parallel/serial conversion circuit is low level, writing the voltage of said second power supply line to one of the load capacitances of said two signal lines and then balancing the charges that have been written to said two load capacitances; and after the process of writing the voltage of a first or a second power supply line to said two load capacitances and balancing the charges has been completed for all bits that make up an image signal, applying the voltage of said load capacitance to each pixel of even-numbered pixel columns.

14. A drive method of a liquid crystal display device for driving a display device according to claim 10, said drive method performing frame inversion drive by switching the voltage of a first power supply line VS with each frame between the lowest voltage VL of the voltages that are applied to pixels and the highest voltage VH of the voltages that are applied to pixels.

15. A drive method of a liquid crystal display device for driving a display device according to claim 10, said drive method performing scanning line inversion drive by switching the voltage of said first power supply line VS with each horizontal interval between the lowest voltage VL of the voltages that are applied to pixels and the highest voltage VH of the voltages that are applied to pixels.

16. A drive method of a liquid crystal display device for driving a display device according to claim 10, said drive method performing signal line inversion drive by making said first power supply line either the highest voltage VH of the voltages that are applied to pixels or the lowest voltage VL of the voltages that are applied to pixels during the first half of a horizontal interval in which writing is performed to odd-numbered pixel columns, and making said first power supply line either said voltage VL or said voltage VH during the second half of a horizontal interval in which writing is performed to even-numbered pixel columns.

17. A drive method of a liquid crystal display device for driving a display device according to claim 10, said drive method comprising steps of:

in the nth row of odd-numbered frames, making said first power supply line the highest voltage VH of the voltages that are applied to pixels during the first half of a horizontal interval in which writing is performed to odd-numbered pixel columns and making said first power supply line the lowest voltage VL of the voltages that are applied to pixels during the second half of a horizontal interval in which writing is performed to even-numbered pixel columns; and in the (n+1)th row of odd-numbered frames, making the voltage of said first power supply line said voltage VL during the first half of a horizontal interval in which writing is performed to odd-numbered pixel columns and making said first power supply line said voltage VH during the second half of a horizontal interval in which writing is performed to even-numbered pixel columns; and in the nth row of even-numbered frames, making the voltage of said first power supply line the lowest voltage VL of the voltages that are applied to pixels during the first half of a horizontal interval in which writing is performed to odd-numbered pixel columns and making the voltage of said first power supply line the highest voltage VH of the voltages that are applied to pixels during the second half of a horizontal interval in which writing is performed to even-numbered pixel columns; and in the (n+1)th row of even-numbered frames, making the voltage of said first power supply line said voltage VH during the first half of a horizontal interval in which writing is performed to odd-numbered pixel columns and making said first power supply line said voltage VL during the second half of a horizontal interval in which writing is performed to even-numbered pixel columns; thereby realizing dot inversion drive.

* * * * *

UNITED STATES PATENT AND TRADEMARK OFFICE

CERTIFICATE OF CORRECTION

PATENT NO. : 6,930,665 B2
APPLICATION NO. : 10/353951
DATED : August 16, 2005
INVENTOR(S) : Hiroyuki Sekine It is certified that error appears in the above-identified patent and that said Letters Patent is hereby corrected as shown below:

IN THE TITLE at Item (54) and Col. 1 lines 1-3:

In Line 1, delete "DISPLAY DEVICE FOR D/A CONVERSION USING LOAD CAPACITANCES OF TWO LINES" and replace with "DISPLAY DEVICE FOR D/A CONVERSION USING LOAD CAPACITANCES OF TWO SIGNAL LINES"

Signed and Sealed this
Twelfth Day of July, 2011

David J. Kappos

David J. Kappos
*Director of the United States Patent and Trademark Office*